US008875780B2

(12) United States Patent
Smith et al.

(10) Patent No.: US 8,875,780 B2
(45) Date of Patent: Nov. 4, 2014

(54) METHODS OF FORMING ENHANCED-SURFACE WALLS FOR USE IN APPARATAE FOR PERFORMING A PROCESS, ENHANCED-SURFACE WALLS, AND APPARATAE INCORPORATING SAME

(75) Inventors: Richard S. Smith, Buffalo, NY (US); Kevin Fuller, Lakeview, NY (US); David J. Kukulka, Snyder, NY (US)

(73) Assignee: Rigidized Metals Corporation, Buffalo, NY (US)

( * ) Notice: Subject to any disclaimer, the term of this patent is extended or adjusted under 35 U.S.C. 154(b) by 1091 days.

(21) Appl. No.: 12/807,131

(22) Filed: Aug. 27, 2010

(65) Prior Publication Data

US 2011/0174473 A1 Jul. 21, 2011

Related U.S. Application Data

(63) Continuation-in-part of application No. 12/754,094, filed on Apr. 5, 2010, now abandoned.

(Continued)

(51) Int. Cl.
*F28F 13/18* (2006.01)
*F28F 1/32* (2006.01)

(Continued)

(52) U.S. Cl.
CPC ..... *F28F 1/325* (2013.01); *F28F 13/185* (2013.01); *F28F 1/426* (2013.01);

(Continued)

(58) Field of Classification Search
CPC ..... B21D 13/00; B21D 13/02; B21D 13/04; B21D 13/045; B21D 13/06; B21D 13/10;

(Continued)

(56) References Cited

U.S. PATENT DOCUMENTS 1,517,633 A * 12/1924 Junkers ..... 428/603
2,641,830 A * 6/1953 Lamb et al. ..... 228/150

(Continued)

FOREIGN PATENT DOCUMENTS

EP 0 052 522 A2 11/1981
EP 1 202 018 A2 10/2001

*Primary Examiner* — Tho V Duong
(74) *Attorney, Agent, or Firm* — Phillip Lytle LLP

(57) ABSTRACT

This invention relates generally to: (1) methods of forming enhanced-surface walls (20) for use in apparatae (e.g., heat transfer devices, fluid mixing devices, etc.) for performing a process, (2) to enhanced-surface walls per se, and (3) to various apparatae incorporating such enhanced-surface walls.

The method improved method broadly comprises the steps of: providing a length of material (21) having opposite initial surfaces (22*a*, 22*b*), said material having a longitudinal centerline (x-x) positioned substantially midway between said initial surfaces, said material having an initial transverse dimension measured from said centerline to a point on either of said initial surfaces located farthest away from said centerline, each of said initial surfaces having a initial surface density, said surface density being defined as the number of characters on an surface per unit of projected surface area; impressing secondary patterns (23*a*, 23*b*) having secondary pattern surface densities onto each of said initial surfaces to distort said material and to increase the surface densities on each of said surfaces and to increase the trans-verse dimension of said material from said centerline to the farthest point of such distorted material; and impressing primary patterns (25*a*, 25*b*) having primary pattern surface densities onto each of such distorted surfaces to further distort said material and to further increase the surface densities on each of said surfaces; thereby to provide an enhanced-surface wall for use in an apparatus for performing a process.

18 Claims, 21 Drawing Sheets

Related U.S. Application Data

(60) Provisional application No. 61/295,653, filed on Jan. 15, 2010.

(51) Int. Cl.
*F28F 1/42* (2006.01)
*F28F 1/00* (2006.01)
*B21B 1/22* (2006.01)

(52) U.S. Cl.
CPC .. *B21B 1/227* (2013.01); *F28F 1/42* (2013.01)
USPC ..... 165/133; 29/727; 72/370.14

(58) Field of Classification Search
CPC ..... B21D 11/06; B21D 11/203; B21D 15/02; B21D 15/12; B21D 9/10; B21D 9/114; B21D 9/14; F28F 1/325; F28F 13/185; F28F 1/426; F28F 1/42; B21B 1/227
USPC ..... 165/133, 177, 179, 181; 72/369, 72/370.19, 368, 370.14, 370.15, 370.16, 72/379.6, 379.2, 365.2, 363, 377; 29/890.053, 45, 283.5, 727
See application file for complete search history.

(56) References Cited

U.S. PATENT DOCUMENTS 3,454,081 A 7/1969 Kun et al.
3,696,861 A 10/1972 Webb
3,730,229 A 5/1973 D'Onofrio
3,831,675 A * 8/1974 McLain ..... 165/177
4,044,797 A 8/1977 Fujie et al.
4,092,842 A * 6/1978 Oser et al. ..... 72/379.6
4,098,722 A * 7/1978 Cairns et al. ..... 502/336
4,159,739 A 7/1979 Brothers et al.
4,216,826 A 8/1980 Fujikake
4,438,807 A 3/1984 Mathur et al.
4,550,776 A 11/1985 Lu
4,649,256 A 3/1987 Minamida et al.
4,658,892 A 4/1987 Shinohara et al.
4,663,243 A 5/1987 Czikk et al.
4,753,849 A 6/1988 Zohler
4,794,983 A 1/1989 Yoshida et al.
4,938,282 A 7/1990 Zohler
5,052,476 A 10/1991 Sukumoda et al.
5,070,937 A 12/1991 Mougin et al.
5,140,123 A 8/1992 Mitani
5,222,299 A 6/1993 Zohler
5,259,448 A 11/1993 Masukawa et al.
5,332,034 A 7/1994 Chiang et al.
5,351,397 A 10/1994 Angeli
5,388,329 A 2/1995 Randlett et al.
5,458,191 A 10/1995 Chiang et al.
5,697,430 A 12/1997 Thors et al.
5,704,424 A 1/1998 Kohno et al.
5,839,505 A 11/1998 Ludwig et al.
5,961,748 A 10/1999 Ono et al.
6,176,301 B1 1/2001 Bennett et al.
6,182,743 B1 2/2001 Bennett et al.
6,497,130 B2 * 12/2002 Nilsson ..... 72/252.5
6,705,143 B2 * 3/2004 Liu ..... 72/52
7,032,654 B2 4/2006 Wand et al.
2004/0099409 A1 5/2004 Bennett et al.
2005/0067156 A1 3/2005 Rottmann
2005/0247380 A1 11/2005 Rottmann
2006/0054035 A1 3/2006 Papadopoulos et al.
2007/0122590 A1 5/2007 Lalvani
2007/0207931 A1 9/2007 Rissanen et al.
2008/0038144 A1 2/2008 Maziasz et al.
2009/0008075 A1 1/2009 Bennet et al.
2009/0202856 A1 * 8/2009 Hiraoka et al. ..... 428/604
2009/0242067 A1 10/2009 Leelaprachakul

* cited by examiner 20
26a
24a
23a
22a
3A
3A
21a
21
Direction of Material Travel 20
x
26a
26b
24a
24b
23a
23b
22a
22b
21a
21b
21
x Secondary 1
23a
23
3B
3B
21
6.0
6.0

Primary 1
25a
25
3C
3C
21
6.0
6.0

Primary 1 and Secondary 1
26a
26
20
3D
3D
21
6.0
6.0

Primary Patterns
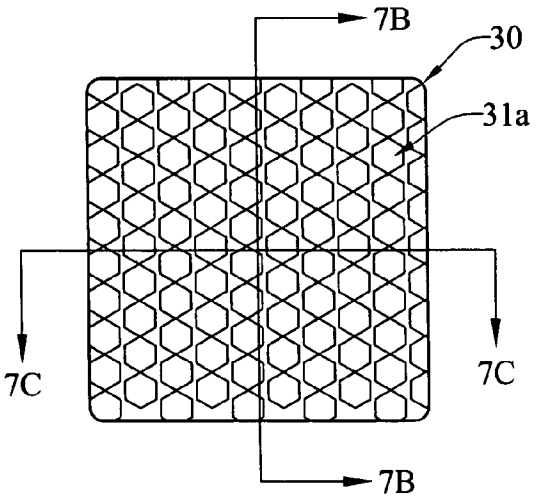
Fig. 7A
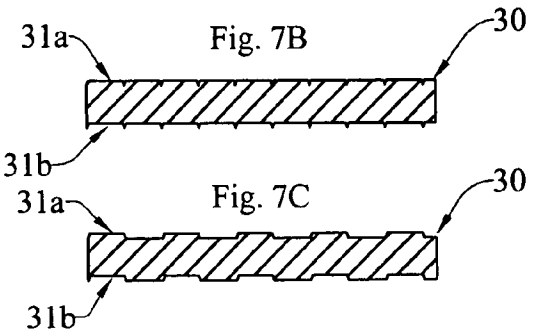
Fig. 7B
Fig. 7C
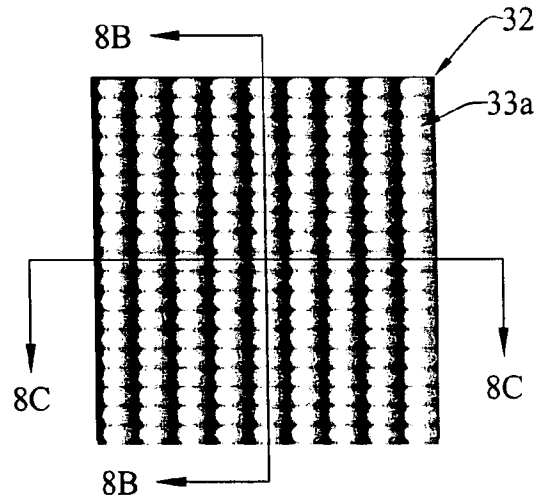
Fig. 8A
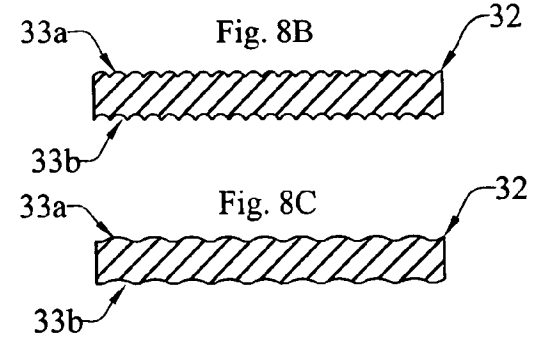
Fig. 8B
Fig. 8C Primary Patterns
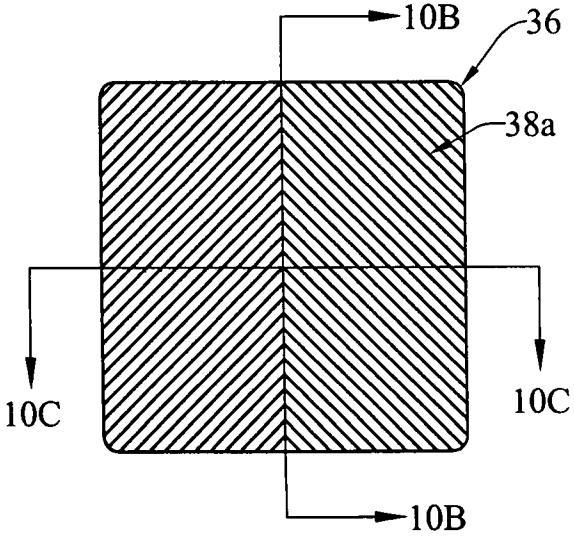
Fig. 10A
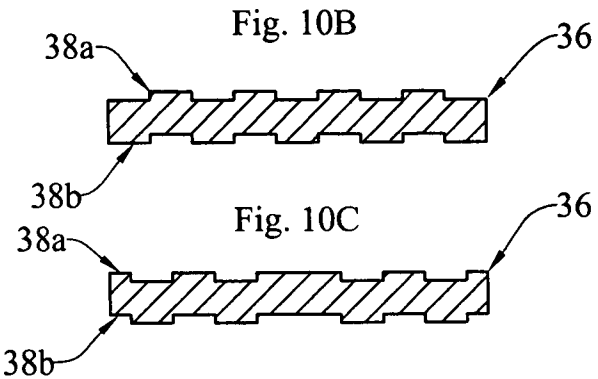
Fig. 10B
Fig. 10C Secondary Patterns Directional Patterns Non-Directional Patterns
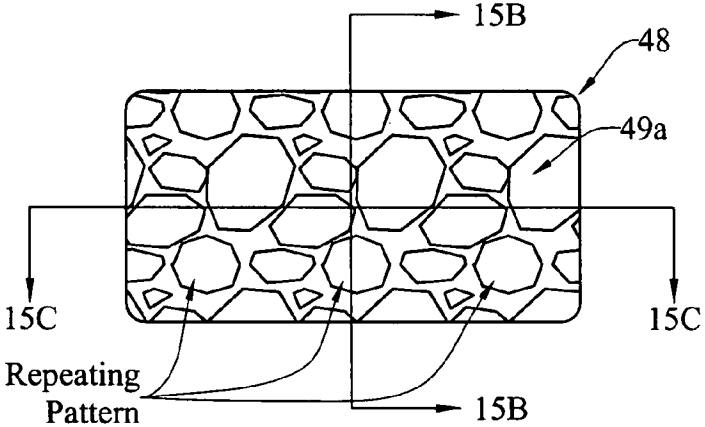
Fig. 15A
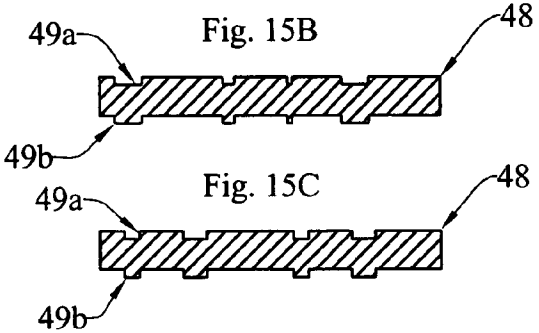
Fig. 15B
Fig. 15C
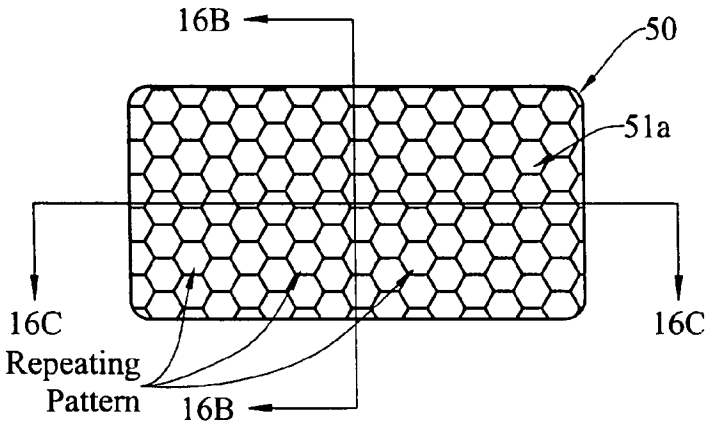
Fig. 16A
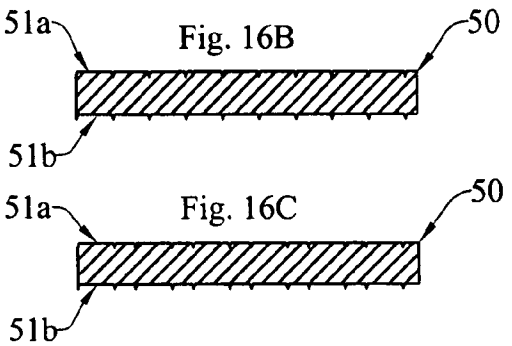
Fig. 16B
Fig. 16C

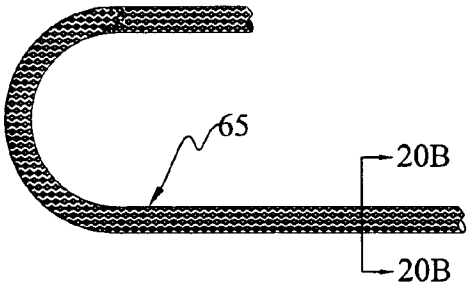
Fig. 20A
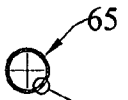
Fig. 20B
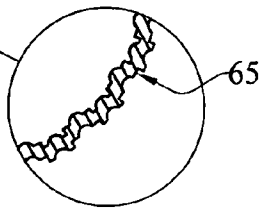
Fig. 20C
Fig. 21A
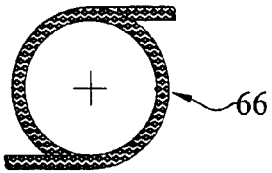
Fig. 21B
Fig. 21C
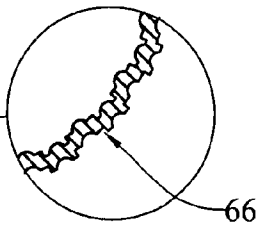
Fig. 21D Smaller Flow-Through Openings
79
77
80

Intermediate Flow-Through Openings
79'
77
80'

Larger Flow-Through Openings
79"
77
80"

Larger Flow-Through Openings
79'''
Smaller Flow-Through Openings
80
Intermediate Flow-Through Openings
80'
77
80"

Smaller Flow-Through Openings
Intermediate Flow-Through Openings
80
Larger Flow-Through Openings
79'''
80"
77

METHODS OF FORMING ENHANCED-SURFACE WALLS FOR USE IN APPARATAE FOR PERFORMING A PROCESS, ENHANCED-SURFACE WALLS, AND APPARATAE INCORPORATING SAME

CROSS-REFERENCE TO RELATED APPLICATION

This application is a continuation-in-part of pending U.S. patent application Ser. No. 12/754,094, filed Apr. 5, 2010, and also claims the benefit of U.S. Provisional Application Ser. No. 61/295,653, filed Jan. 15, 2010, the entire disclosures of both of which are hereby incorporated by reference.

TECHNICAL FIELD

The present invention relates generally to methods of forming enhanced-surface walls for use in apparatae (e.g., heat transfer devices, fluid-mixing devices, etc.) for performing a process, to enhanced-surface walls per se, and to various apparatae incorporating such enhanced-surface walls.

BACKGROUND ART

It is known to provide enhanced-surface walls for use in heat exchangers and fluid-mixing devices. Such walls typically have a plurality of characters impressed thereon to enhance the surface area, to improve fluid mixing, to promote turbulence, to break up the boundary layer adjacent the surface, to improve heat transfer, etc.

U.S. Pat. No. 5,052,476 A appears to disclose a heat transfer tube having U-shaped primary grooves, V-shaped secondary grooves, and pear-shaped tertiary grooves to increase turbulence and reflux efficiency. The tube is first formed as a plate, and is then rolled into a tube, after which its proximate ends are welded together. The depth of the secondary grooves is said to be 50-100% of the depth of the primary grooves.

U.S. Pat. No. 5,259,448 A appears to disclose a heat transfer tube having rectangularly-shaped main grooves and narrow secondary grooves that intersect the main grooves at an angle. The device appears to be formed flat, rolled or curled, and then welded. The depth of the narrow grooves is said to be 0.02 millimeters (mm). The depth of the main grooves is said to be 0.20-0.30 mm.

U.S. Pat. No. 5,332,034 A appears to disclose a heat exchanger tube having longitudinally-extending circumferentially-spaced ribs with parallel inclined notches to increase turbulence and to increase heat transfer performance.

U.S. Pat. No. 5,458,191 A appears to disclose a heat exchanger tube having circumferentially-spaced helically-wound ribs with parallel inclined notches.

U.S. Pat. No. 6,182,743 B1 appears to disclose a heat transfer tube with polyhedral arrays to enhance heat transfer characteristics. The polyhedral arrays may be applied to internal and external tube surfaces. This reference may teach the use of ribs, fins, coatings and inserts to break up the boundary layer.

U.S. Pat. No. 6,176,301 B1 appears to disclose a heat transfer tube with polyhedral arrays having crack-like cavities on at least two surfaces of the polyhedrons.

US 2005/0067156 A1 appears to disclose a heat transfer tube that is cold- or forge-welded, and that has dimpled patterns thereon of various shapes.

US 2005/0247380 A1 appears to disclose a heat transfer tube of tin-brass alloys to resist formicary (i.e., ant-like) corrosion.

US 2009/0008075 A1 appears to disclose a heat transfer tube having arrays of polyhedrons, with the second array being arranged at an angle with respect to the first.

U.S. Pat. No. 5,351,397 A appears to disclose a roll-formed nucleate boiling pate having a first pattern of grooves separated by ridges, and a second pattern of more-shallow groves machined into the ridges. The second pattern depth is said to be about 10-50% of the depth of the first pattern.

U.S. Pat. No. 7,032,654 B2 appears to disclose a heat exchanger having fins with enhanced-surfaces, and with holes in the fins.

U.S. Pat. No. 4,663,243 A appears to disclose a heat exchanger surface having flame-sprayed ferrous alloy enhanced boiling surfaces.

Finally, U.S. Pat. No. 4,753,849 appears to disclose a heat exchanger tube with a porous coating to enhanced heat transfer.

DISCLOSURE OF THE INVENTION

With parenthetical reference to the corresponding parts, portions or surfaces of one or more of the disclosed embodiments, merely for purposes of illustration and not by way of limitation, the present invention broadly provides: (1) improved methods of forming enhanced-surface walls for use in apparatae (e.g., heat transfer devices, fluid mixing devices, etc.) for performing a process, (2) to enhanced-surface walls per se, and (3) to various apparatae incorporating such enhanced-surface walls.

In one aspect, the invention provides an improved method of forming an enhanced-surface wall (20) for use in an apparatus for performing a process, comprising the steps of: providing a length of material (21) having opposite initial surfaces (21*a*, 21*b*), the material having a longitudinal centerline (x-x) positioned substantially midway between the initial surfaces, the material having an initial trans-verse dimension measured from the centerline to a point on either of the initial surfaces located farthest away from the centerline, each of the initial surfaces having a initial surface density, the surface density being defined as the number of characters on an surface per unit of projected surface area; impressing secondary patterns (23*a*, 23*b*) having secondary pattern surface densities onto each of the initial surfaces to distort the material and to increase the surface densities on each of the surfaces and to increase the transverse dimension of the material from the centerline to the farthest point of such distorted material; and impressing primary patterns (25*a*, 25*b*) having primary pattern surface densities onto each of such distorted surfaces to further distort the material and to further increase the surface densities on each of the surfaces; thereby to provide an enhanced-surface wall for use in an apparatus for performing a process.

Each secondary pattern surface density may be greater than each primary pattern surface density.

The step of impressing the secondary patterns onto each of the initial surfaces may include the additional step of: cold-working the material.

The step of impressing the primary patterns onto each of distorted surfaces may include the additional step of: cold-working the material.

The secondary patterns may be the same.

The secondary patterns may be shifted relative to one another such that a maximum dimension from the centerline to one distorted surface will correspond to a minimum dimension from the centerline to the other distorted surface.

The step of impressing the secondary patterns onto the material may increase the maximum transverse dimension of the material from the centerline to the farthest point of the distorted material of up to 135% of the maximum transverse dimension from the centerline to the farthest point on the initial surface.

The step of impressing the secondary patterns onto the material may increase the maximum transverse dimension of the material from the centerline to the farthest point of the distorted material of up to 150% of the maximum transverse dimension from the centerline to the farthest point on the initial surface.

The step of impressing the secondary patterns onto the material may increase the maximum transverse dimension of the material from the centerline to the farthest point of the distorted material of up to 300% of the maximum transverse dimension from the centerline to the farthest point on the initial surface.

The step of impressing the secondary patterns onto the material may increase the maximum transverse dimension of the material from the centerline to the farthest point of the distorted material of up to 700% of the maximum transverse dimension from the centerline to the farthest point on the initial surface.

The step of impressing the secondary patterns onto the material may not reduce the minimum dimension of the material, when measured from any point on one of such distorted surfaces to the closest point on the opposite one of such distorted surfaces, below 95% of the minimum dimension from any point on one of the initial surfaces to the closest point on the opposite initial surface.

The step of impressing the secondary patterns onto the material may not reduce the minimum dimension of the material, when measured from any point on one of such distorted surfaces to the closest point on the opposite one of such distorted surfaces, below 50% of the minimum dimension from any point on one of the initial surfaces to the closest point on the opposite initial surface.

The primary patterns may be the same.

The primary patterns may be shifted relative to one another such that a maximum dimension from the centerline to one further-distorted surface will correspond to a minimum dimension from the centerline to the other further-distorted surface.

The step of impressing the primary patterns onto the material may not reduce the minimum dimension of the further-distorted material, when measured from the centerline to any point on either of the further-distorted surfaces, below 95% of the minimum dimension of the material, when measured from the centerline to either of the initial surfaces.

The step of impressing the primary patterns onto the material may not reduce the minimum dimension of the further-distorted material, when measured from the centerline to any point on either of the further-distorted surfaces, below 50% of the minimum dimension of the material, when measured from the centerline to either of the initial surfaces.

The step of impressing the primary patterns onto each of the surfaces may further increase the dimension from the centerline to the farthest point of the further-distorted material.

The opposite surfaces of the material may be initially planar.

The steps of impressing the patterns may include the steps of impressing the patterns by at least one of a rigidizing, stamping, rolling, pressing and embossing operation.

The method may further comprise the additional steps of: bending the enhanced-surface wall such that the proximate ends are positioned proximate to one another; and joining the proximate ends of the material together; thereby to form an enhanced-surface tube.

The step of joining the proximate ends of the material together may include the further step of: welding the proximate ends of the material to join them together.

The method may further comprise the additional step of: providing holes through the material.

The method may further comprise the additional step of: installing the enhanced-surface wall in a heat exchanger.

The method may further comprise the additional step of: installing the enhanced-surface wall in a fluid-handling apparatus.

In another aspect, the invention provides an enhanced-surface wall manufactured by the method defined by any of the foregoing steps.

The primary patterns may be directional or non-directional.

The secondary patterns may be directional or non-directional.

The wall may comply with at least one of the following ASME/ASTM designations: A249/A, A135, A370, A751, E213, E273, E309, E1806, A691, A139, A213, A214, A268, A 269, A270, A312, A334, A335, A498, A631, A671, A688, A691, A778, A299/A, A789, A789/A, A789/M, A790, A803, A480, A763, A941, A1016, A1012, A1047/A, A250, A771, A826, A851, 8674, E112, A370, A999, E381, E426, E527, E340, A409, A358, A262, A240, A537, A530, A 435, A387, A299, A204, A20, A577, A578, A285, E165, A380, A262 and A179. The aggregate disclosure of each of these designations is hereby incorporated by reference.

The material may be homogeneous or non-homogeneous.

The material may be provided with a coating on at least a portion of one of the initial surfaces.

At least a portion of one of the initial surfaces may be chemically-treated.

In another aspect, the invention provides an improved heat transfer device that incorporates the improved enhanced-surface wall.

In another aspect, the invention provides an improved fluid-handling apparatus that incorporates the improved enhanced-surface wall.

In another aspect the invention provides an improved enhanced-surface wall (20) for use in an apparatus for performing a process, which wall comprises: a length of material (21) having opposite initial surfaces (21*a*, 21*b*), the material having a longitudinal centerline (x-x) positioned substantially midway between the initial surfaces, the material having an initial transverse dimension measured from the centerline to a point on either of the initial surfaces located farthest away from the center-line, each of the initial surfaces having a initial surface density, the surface density being defined as the number of characters (including zero) on a surface per unit of projected surface area; secondary patterns (23) having secondary pattern surface densities impressed onto each of the initial surfaces, the secondary patterns distorting the material and increasing the surface densities on each of the surfaces and increasing the transverse dimension of the material from the centerline to the farthest point of such distorted material; and primary patterns (25) having primary pattern surface densities impressed onto each of such distorted surfaces and further distorting the material and further increasing the surface densities on each of the surfaces.

Each secondary pattern surface density may be greater than each primary pattern surface density.

The secondary patterns may be the same.

The secondary patterns may be shifted relative to one another such that a maximum dimension from the centerline to one distorted surface will correspond to a minimum dimension from the centerline to the other distorted surface.

The maximum transverse dimension of the material from the centerline to the farthest point of the distorted material may be less than 135% of the maximum transverse dimension from the centerline to the farthest point on the initial surface.

The maximum transverse dimension of the material from the centerline to the farthest point of the distorted material may be less than 150% of the maximum transverse dimension from the centerline to the farthest point on the initial surface.

The maximum transverse dimension of the material from the centerline to the farthest point of the distorted material may be less than 300% of the maximum transverse dimension from the centerline to the farthest point on the initial surface.

The maximum transverse dimension of the material from the centerline to the farthest point of the distorted material may be less than 700% of the maximum transverse dimension from the centerline to the farthest point on the initial surface.

The minimum dimension of the material, when measured from any point on one of such distorted surfaces to the closest point on the opposite one of such distorted surfaces, is at least 95% of the minimum dimension from any point on one of the initial surfaces to the closest point on the opposite initial surface.

The minimum dimension of the material, when measured from any point on one of such distorted surfaces to the closest point on the opposite one of such distorted surfaces, may be at least 50% of the minimum dimension from any point on one of the initial surfaces to the closest point on the opposite initial surface.

The primary patterns may be the same or different.

The primary patterns may be shifted relative to one another such that a maximum dimension from the centerline to one further-distorted surface will correspond to a minimum dimension from the centerline to the other further-distorted surface.

The minimum dimension of the further-distorted material, when measured from the centerline to any point on either of the further-distorted surfaces, may be at least 95% of the minimum dimension of the material, when measured from the centerline to either of the initial surfaces.

The minimum dimension of the further-distorted material, when measured from the centerline to any point on either of the further-distorted surfaces, may be at least 50% of the minimum dimension of the material, when measured from the centerline to either of the initial surfaces.

The impressed primary patterns may further increase the dimension from the centerline to the farthest point of the further-distorted material.

Accordingly, one object is to provide improved methods of forming enhanced-surface walls for use in an apparatus for performing a process.

Another object is to provide improved enhanced-surface walls.

Still another object is to provide an improved apparatus that incorporates an improved enhanced-surface wall.

These and other objects and advantages will become apparent from the foregoing and ongoing written specification, the drawings and the appended claims.

BRIEF DESCRIPTION OF THE DRAWINGS

FIG. 7A is a top plan view showing another primary pattern, designated the Primary 2 pattern, impressed on a sheet.

FIG. 7B is a fragmentary transverse vertical sectional view thereof taken on line 7B-7B of FIG. 7A.

FIG. 7C is a fragmentary transverse horizontal sectional view thereof, taken generally on line 7C-7C of FIG. 7A.

FIG. 8A is a top plan view of a third primary pattern, designated the Primary 3 pattern, impressed on a sheet of material.

FIG. 8B is a fragmentary transverse vertical sectional view thereof, taken generally on line 8B-8B of FIG. 8A.

FIG. 8C is a fragmentary transverse horizontal sectional view thereof, taken generally on line 8C-8C of FIG. 8A.

FIG. 10A is a top plan view of another primary pattern, designated the Primary 5 pattern, impressed on a sheet of material.

FIG. 10B is a fragmentary transverse vertical sectional view thereof, taken generally on line 10B-10B of FIG. 10A.

FIG. 10C is a fragmentary transverse horizontal sectional view thereof, taken generally on line 10C-10C of FIG. 10A.

FIG. 11B is a fragmentary transverse vertical sectional view thereof, taken generally on line 11B-11B of FIG. 11A.

FIG. 11C is a fragmentary transverse horizontal sectional view thereof, taken generally on line 11C-11C of FIG. 11A.

FIG. 12B is a fragmentary transverse vertical sectional view thereof, taken generally on line 12B-12B of FIG. 12A.

FIG. 12C is a fragmentary transverse horizontal sectional view thereof, taken generally on line 12C-12C of FIG. 12A.

FIG. 15A is a fragmentary view of another pebble-like non-directional pattern, designated as Secondary 4 pattern, impressed on a length of material.

FIG. 15B is a fragmentary transverse vertical sectional view thereof, taken generally on line 15B-15B of FIG. 15A.

FIG. 15C is a fragmentary transverse horizontal sectional view thereof, taken generally on line 15C-15C of FIG. 15A.

FIG. 16A is a top plan view of yet another honeycomb-like non-directional pattern, designated Secondary 4 pattern, impressed on the length of material.

FIG. 16B is a fragmentary transverse vertical sectional view thereof, taken generally on line 16B-16B of FIG. 15A.

FIG. 16C is a fragmentary transverse horizontal sectional view thereof, taken generally on line 16C-16C of FIG. 16A.

FIG. 20A is a side elevation of a U-shaped tube.

FIG. 20B is a slightly-enlarged fragmentary transverse vertical sectional view thereof, taken generally on line 20B-20B of FIG. 20A.

FIG. 20C is a further-enlarged detail view of a portion of the tube wall, this view being taken within the indicated circle of FIG. 20B.

FIG. 21A is a side elevation of a helically-wound coil formed of a round tube having enhanced inner and outer surfaces.

FIG. 21B is a top plan view of the coil shown in FIG. 21A.

FIG. 21C is an enlarged fragmentary vertical sectional view thereof, taken generally on line 21C-21C of FIG. 21A, showing the tube in the coil.

FIG. 21D is a further-enlarged detail view, taken within the indicated circle of FIG. 21C, showing of a portion of the tube wall.

DESCRIPTION OF THE PREFERRED EMBODIMENTS

Figures 1A, 1B, 2A, 2B, 2C:
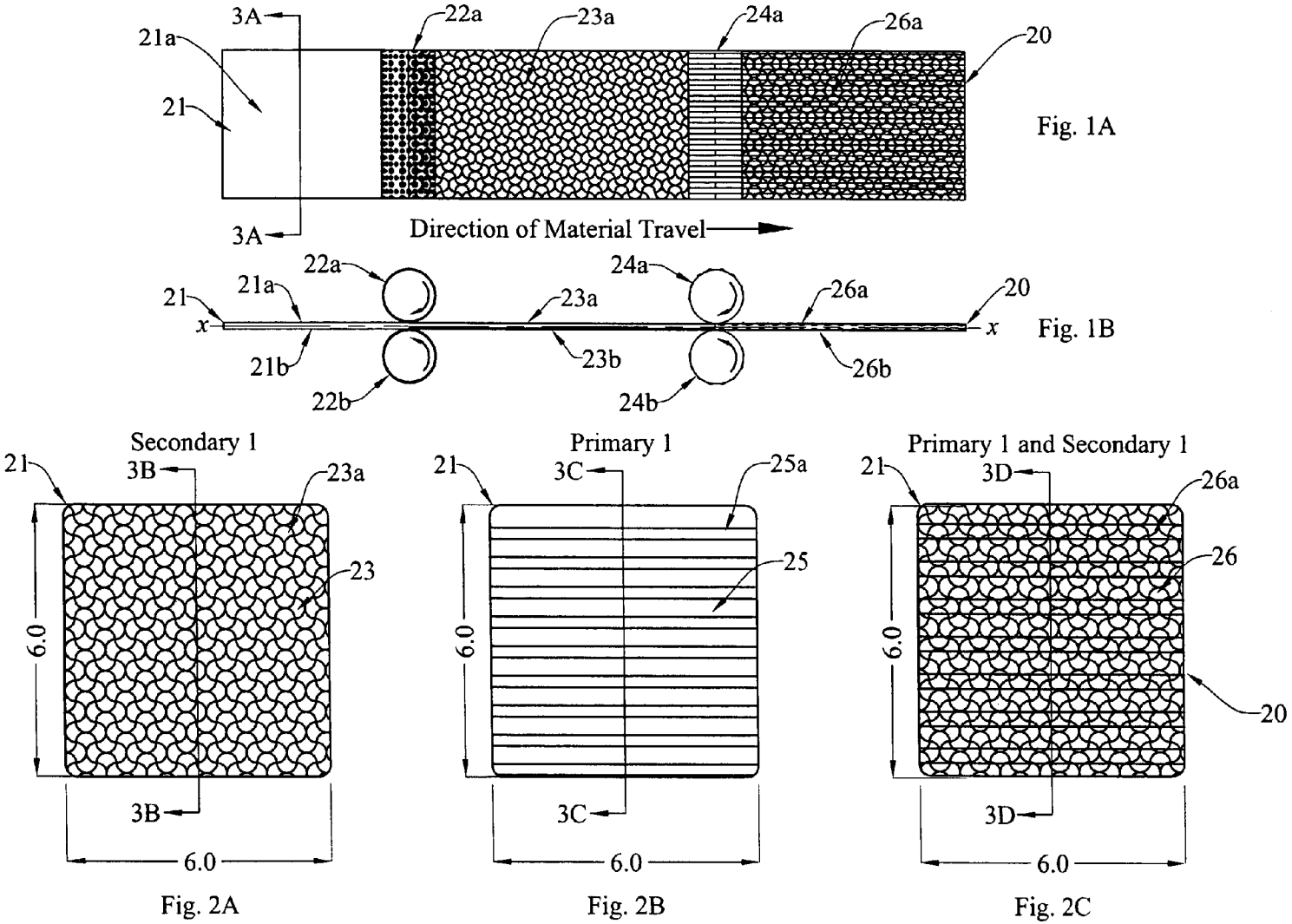
FIG. 1A is a schematic top plan view of a length of material showing the Secondary 1 and Primary 1 patterns being impressed thereon.
FIG. 1B is a side elevation of the structure schematically shown in FIG. 1A.
FIG. 2A is an enlarged top plan view of the Secondary 1 pattern, as shown in FIGS. 1A-1B, impressed into the material.
FIG. 2B is an enlarged top plan view of the Primary 1 pattern impressed into a sheet of supplied material, the scale of FIG. 2B being the same as the scale of FIG. 2A
FIG. 2C is a top plan view of the superimposed Primary 1 and Secondary 1 patterns, as shown in FIGS. 1A-1B, impressed into the material, the scale of FIG. 2C being the same as the scale of FIGS. 2A-2B.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Unless otherwise indicated, all dimensions set forth in the present specification, and in the accompanying drawings, are expressed in inches.

Referring now to the drawings, and more particularly to FIGS. 1-3 thereof, the present invention broadly provides an improved method of forming an enhanced-surface wall 20 for use in an apparatus for performing a process. The apparatus may be a heat transfer device, a type of fluid mixing apparatus (either with or without a pertinent heat exchange function), or some other form of apparatus.

This application discloses multiple embodiments of enhanced-surface walls having various primary and/or secondary patterns. The first embodiment is illustrated in FIGS. 1A-6D, the second in FIGS. 7A-7C, the third in FIGS. 8A-8C, the fourth in FIGS. 9A-9C, the fifth in FIGS. 10A-10C, the sixth in FIGS. 11A-11C, the seventh in FIGS. 12A-12C, the eighth in FIGS. 13A-13B, the ninth in FIGS. 14A-14C, the tenth in FIGS. 15A-15C, and the eleventh in FIGS. 16A-16C. These various patterns may be used in various combinations with one another, and are not exhaustive of all patterns falling within the scope of the appended claims.

Figure 17:
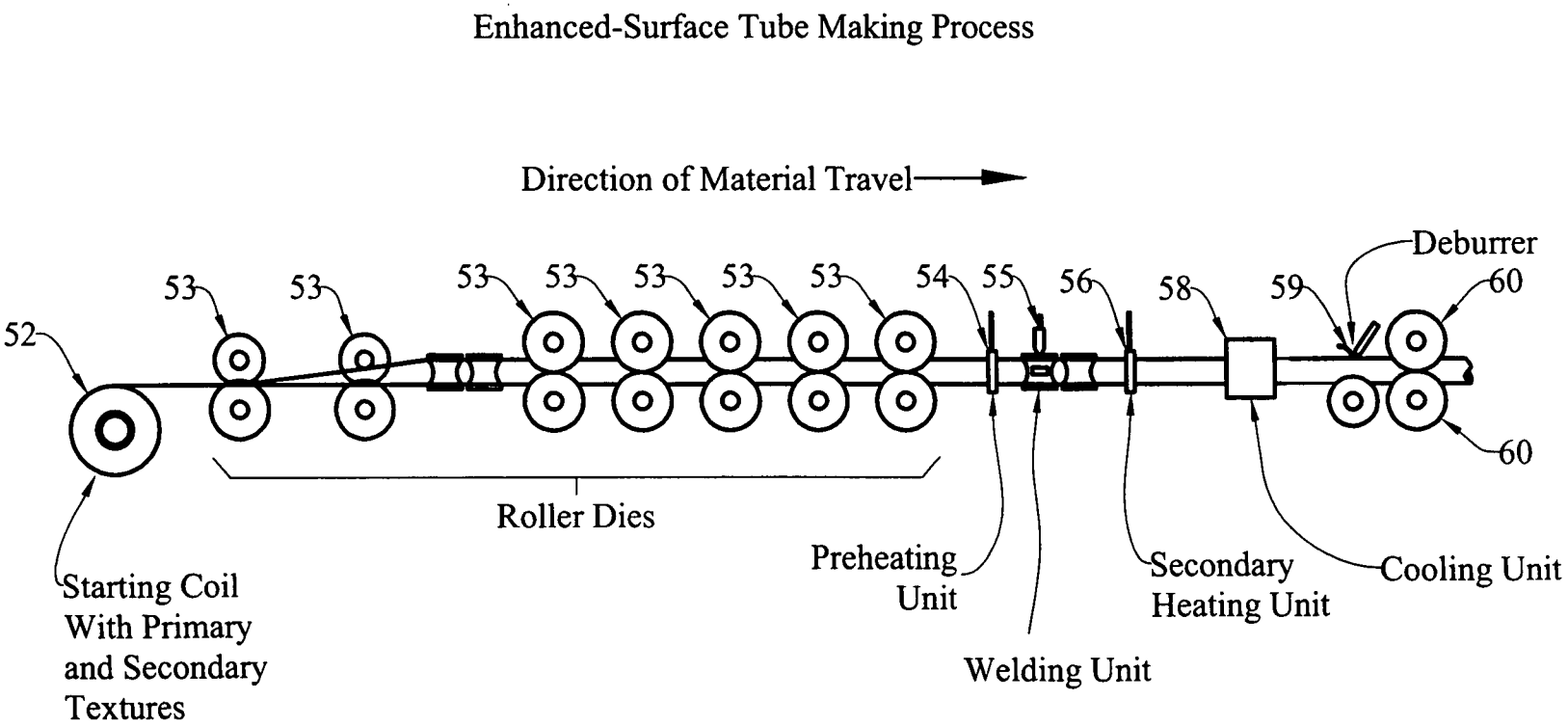
FIG. 17 is a schematic view of one process for making enhanced-surface tubes.

One process of making an enhanced-surface tube is schematically shown in FIG. 17, and several variations of such tubes are depicted in FIGS. 18A-21D.

Figure 22:
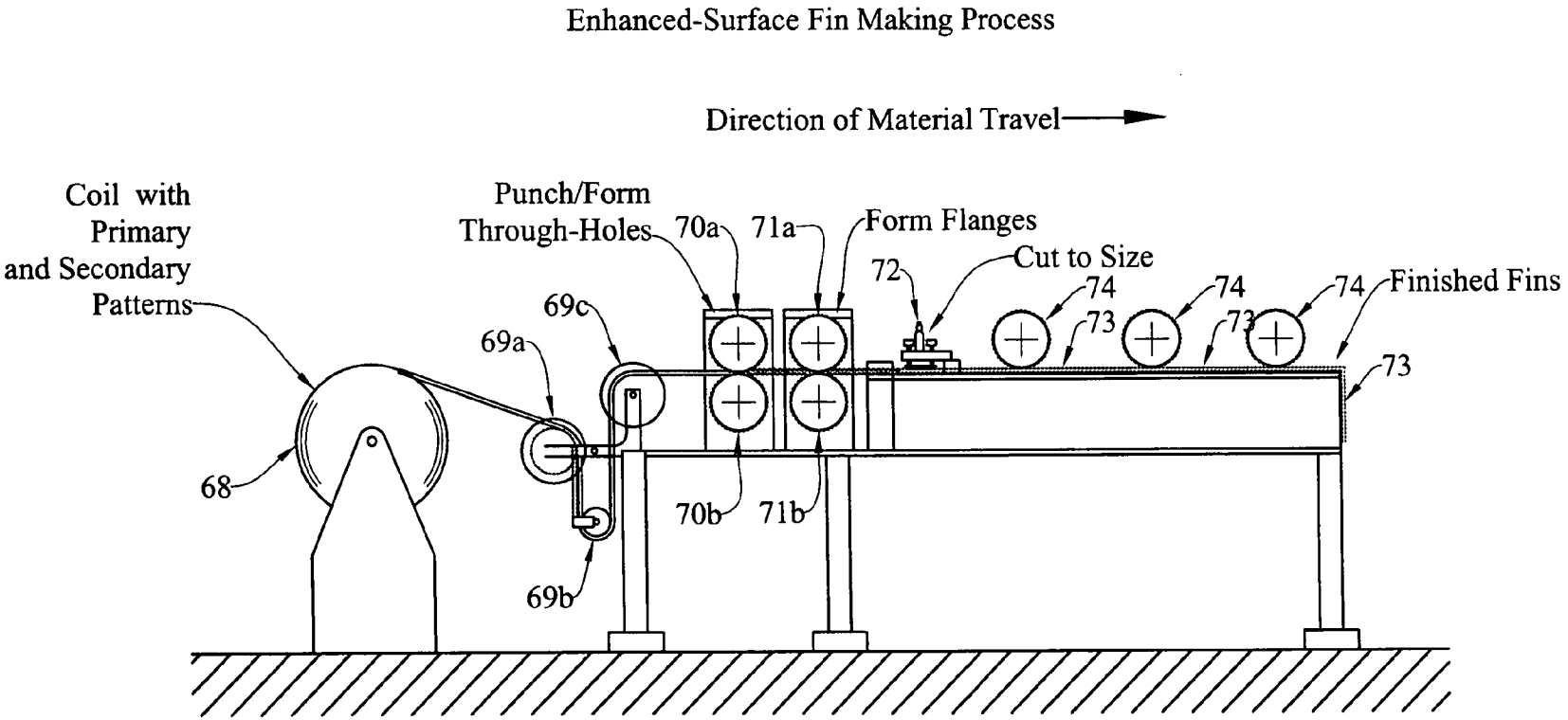
FIG. 22 is a schematic view of one process for making an enhanced-surface fin.

One process for making an enhanced-surface fin is schematically shown in FIG. 22, and several variations of such fins are shown in FIGS. 23A-25E.

Figure 26:
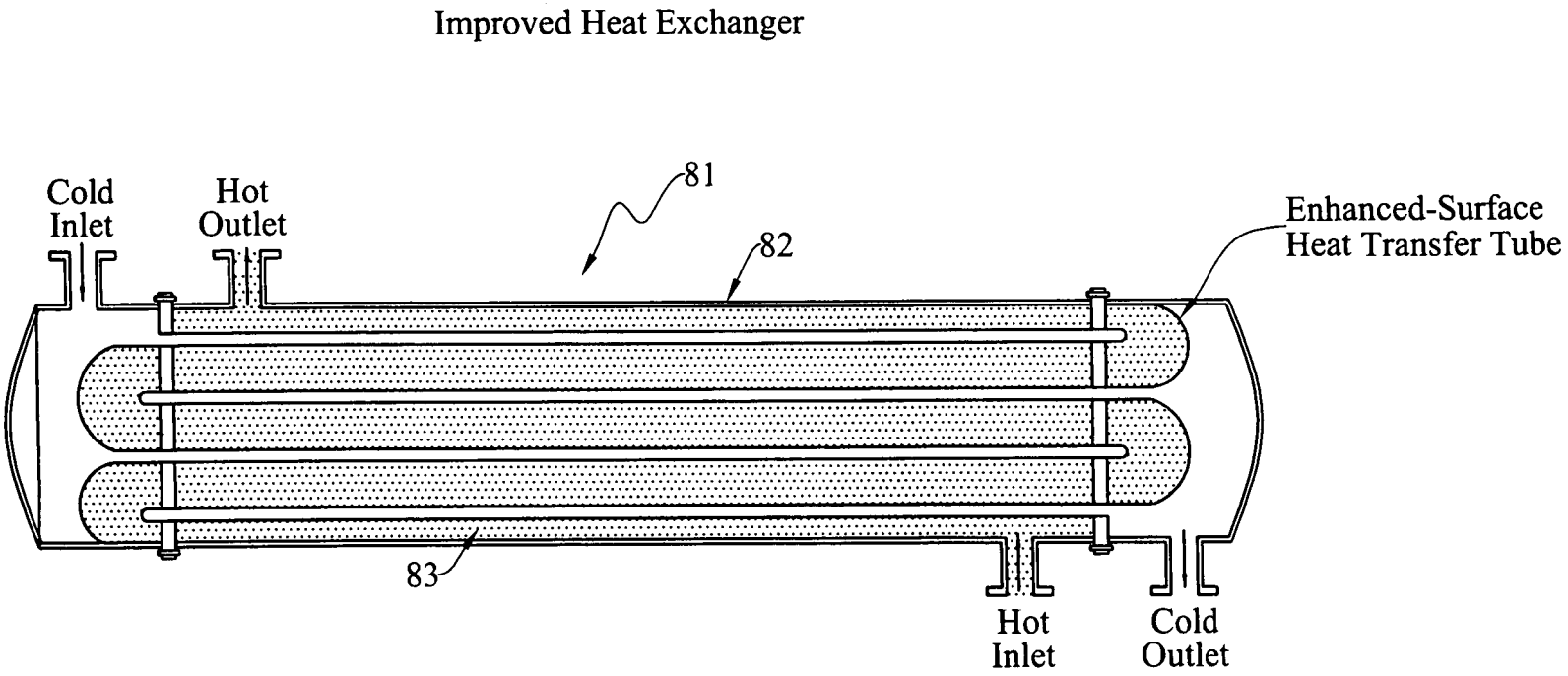
FIG. 26 is a schematic view of an improved heat exchanger having an enhanced-surface heat transfer tube therewithin.

An improved heat exchanger incorporating the enhanced-surface tubes is schematically shown in FIG. 26.

A cooler incorporating such enhanced-surface fins is depicted in FIGS. 27A-27E.

Figure 28:
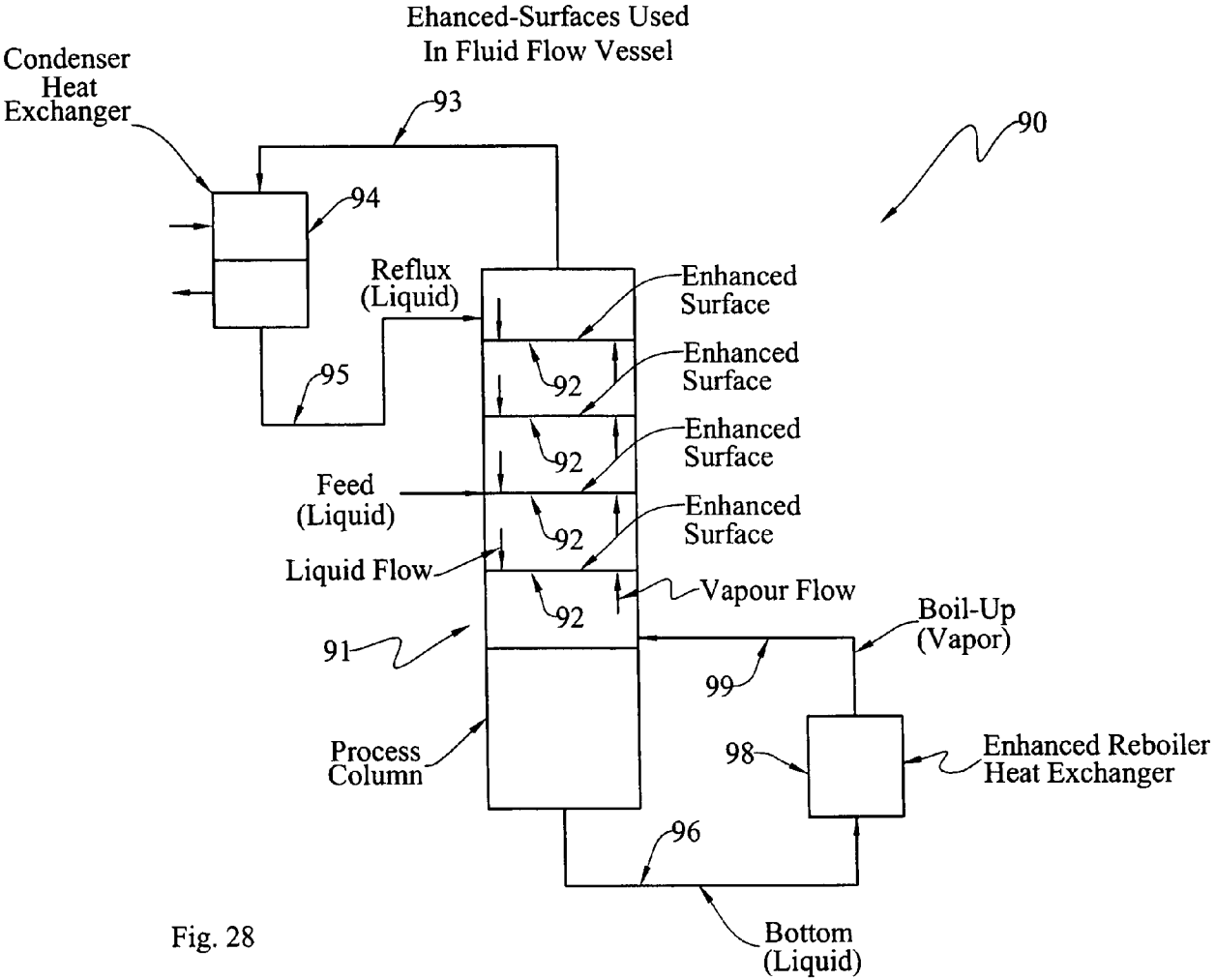
FIG. 28 is a schematic view of a fluid flow vessel incorporating enhanced surfaces therewithin.

Another fluid flow vessel incorporated enhanced surfaces is depicted in FIG. 28.

Figure 29B:
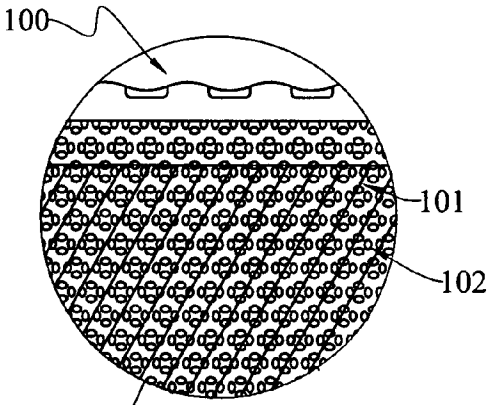
FIG. 29B is an enlarged detail view of a portion of the heat exchanger plate, this view being taken within the indicated circle in FIG. 29A.
Figure 29A:
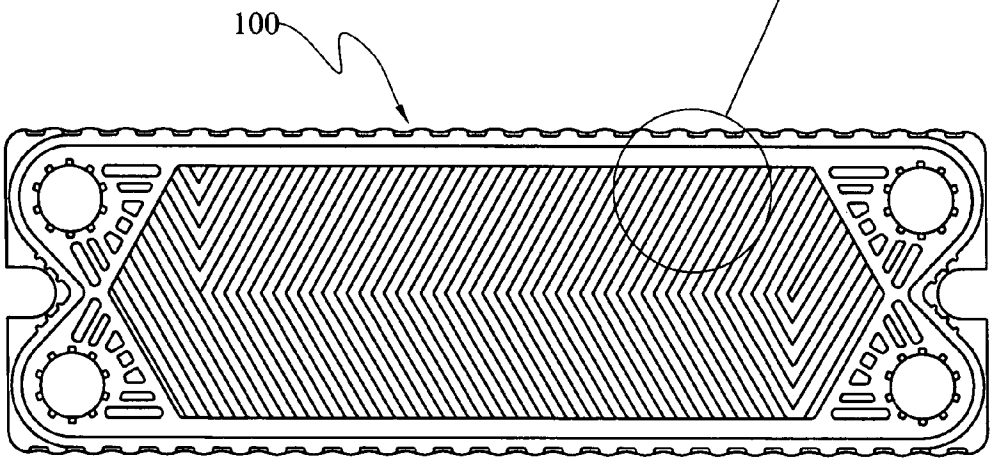
FIG. 29A is a top plan view of a heat exchanger plate incorporating enhanced surfaces therewithin.

Finally, an improved plate having various enhanced surfaces is shown in FIGS. 29A-29B.

These various embodiments and applications will be described seriatim herebelow.

First Embodiment (FIGS. 1A-6D)

Figures 3A, 3B, 3C, 3D:
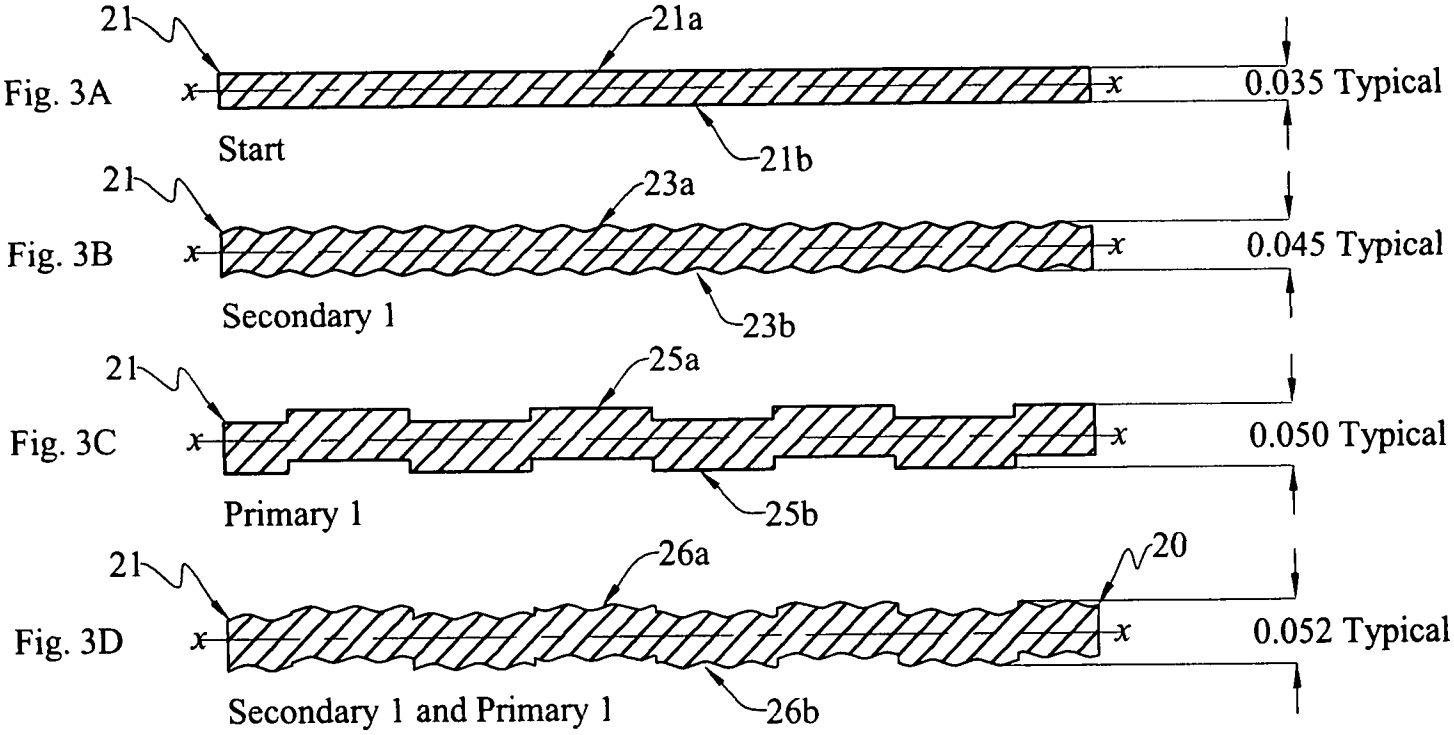
FIG. 3A is a greatly-enlarged fragmentary transverse vertical sectional view of the material prior to impressing the Secondary 1 patterns thereon, this view being taken generally on line 3A-3A of FIG. 1A.
FIG. 3B is a greatly-enlarged fragmentary transverse vertical sectional view thereof, taken generally on line 3B-3B of FIG. 2A, showing the Secondary 1 patterns impressed onto the material.
FIG. 3C is a greatly-enlarged fragmentary transverse sectional view, taken generally on line 3C-3C of FIG. 2B, showing the Primary 1 patterns impressed into the material.
FIG. 3D is a greatly-enlarged fragmentary transverse sectional view thereof, taken generally on line 3D-3D of FIG. 2C, showing the Primary 1 and Secondary 1 patterns impressed into the material.

The improved method broadly begins with providing a length of material, of which a fragmentary portion is generally indicated at 21. This material may be a piece of plate-like stock, may be unrolled from a coil, or may have some other source or configuration. The material may be rectangular having planar upper and lower initial surfaces 21*a*, 21*b*, respectively, and may have a longitudinal transverse centerline x-x positioned substantially midway between these initial surfaces. As shown in FIG. 3A, the thickness of the material between initial surfaces 21*a*-21*b* may be about 0.035 inches, and the nominal spacing from the centerline to either of the surfaces may therefore be about 0.0175 inches.

The leading edge of the material in this first embodiment is then passed rightwardly (in the direction of the indicated arrow in FIG. 1A) between a pair of upper and lower first rolls or dies 22*a*, 22*b*, respectively, which impress the Secondary 1 patterns into the upper and lower surfaces, respectively, of the material. The upper and lower surfaces of the material after the Secondary 1 patterns have been impressed thereon are indicated at 23*a*, 23*b* respectively. The material is then translated rightwardly between a second pair of upper and lower rolls or dies 24*a*, 24*b* respectively, which impress Primary 1 patterns onto the upper and lower surfaces, respectively of the material.

FIGS. 2A and 3B show the shape and configuration of the material after the Secondary 1 patterns have been impressed thereon. The Secondary 1 patterns have the shape of an array of interlocking paving blocks when seen in top plan (FIG. 2A), but have undulating or sinusoidal shapes when seen in cross-section (FIG. 3B).

FIGS. 2B and 3C show the shape of the Primary 1 patterns if such patterns were impressed into a sheet of plain stock material, without the Secondary 1 patterns impressed thereon. As shown in FIGS. 2B and 3C, the Primary 1 patterns are in the form of a series of repeating step-like functions. In FIGS. 2B and 3C, the upper surface of the material is indicated at 25*a*, and the lower surface thereof is indicated at 25*b*.

Thus, the material exiting the second dies has the Primary 1 and Secondary 1 patterns superimposed and impressed thereon. These upper and lower surfaces of the material containing the superimposed Primary 1 and Secondary 1 patterns are indicated at 26*a*, 26*b*, respectively.

As shown in FIGS. 3A-3B, the step of impressing the Secondary 1 patterns onto the material increases the minimal initial area wall thickness of the material from about 0.035 inches to about 0.045 inches. As shown in FIGS. 3A and 3C, the step of impressing the Primary 1 patterns into the initially supplied material would increase the initial area wall thickness from about 0.035 inches to about 0.050 inches. However, as shown in FIG. 3D, when the Primary 1 patterns are superimposed on the Secondary 2 patterns, the thickness of the material, as distorted by the Secondary 1 patterns (i.e., 0.045 inches), is further distorted to a dimension of about 0.052 inches.

In the accompanying drawings, FIGS. 2A-2C are drawn to the same scale (as indicated by the 6.0×6.0 dimensions thereon), and are enlarged with respect to the structure shown in FIG. 1A. FIGS. 3A-3D are also drawn to the same scale, which is further-enlarged with respect to the scale of FIGS. 2A-2C, and is greatly enlarged with respect to the scale of FIGS. 1A-1B.

Figure 4:
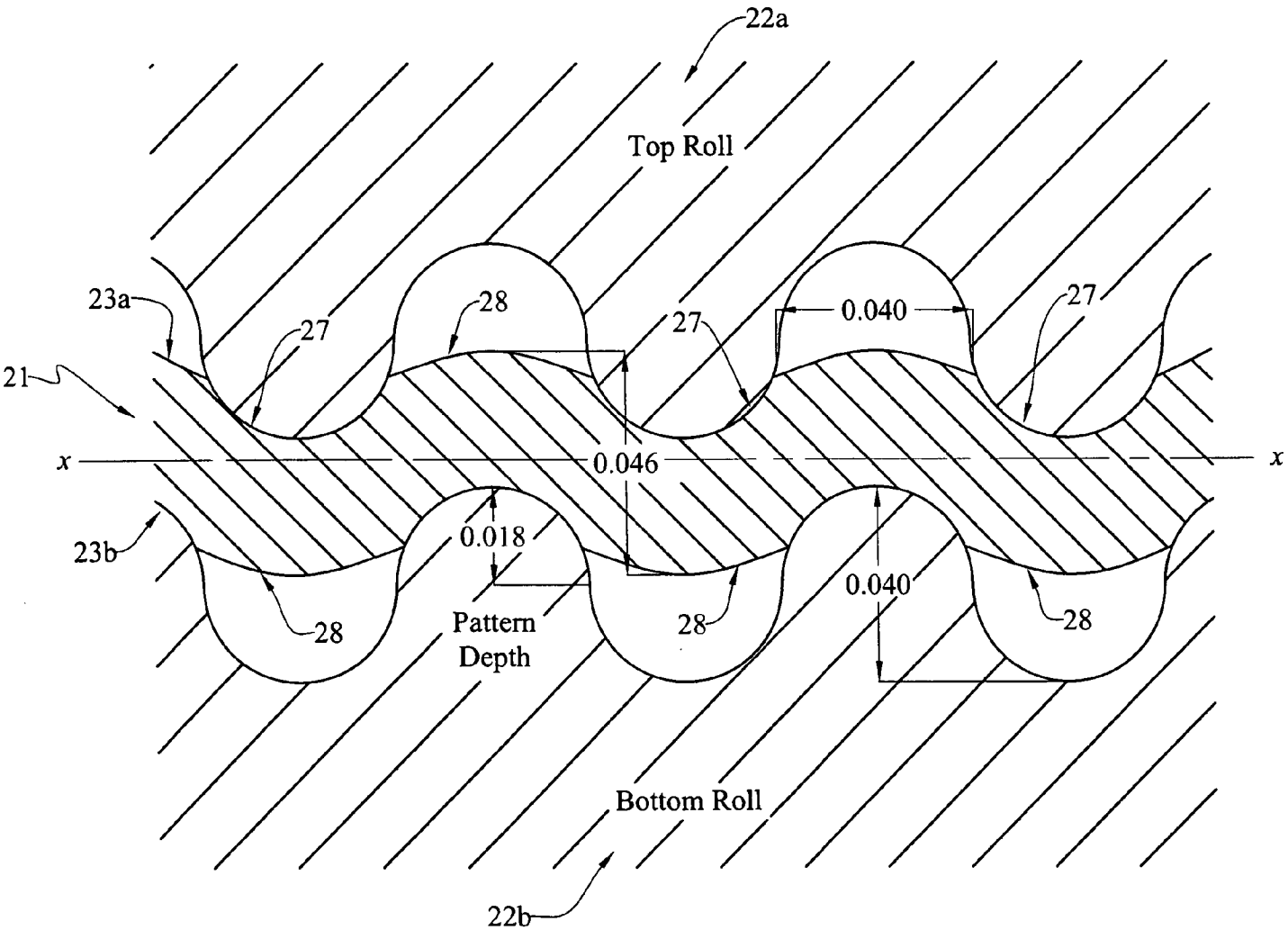
FIG. 4 is a schematic transverse vertical sectional view thereof, showing how the Secondary 1 patterns are impressed into the material.

FIG. 4 shows how the Secondary 1 patterns are impressed into the material. To this end, the top and bottom rolls 22*a*, 22*b* impart the undulating sinusoidal Secondary 1 patterns that are vertically aligned with one another such that the peak of one is aligned with the valley of the other. The material 21 is only partially deformed by the two rolls. Thus, the material will have a series of dimple-like concavities indicated at 27, separated by intermediate arcuate convexities, severally indicated at 28. In an alternative process, the material could be fully deformed, or "coined", between the upper and lower rolls.

In the preferred embodiment, the steps of impressing the primary and secondary patterns into the material has the effect of cold-working the material. However, in an alternative process, the material could be heated, and the process could include the step of hot-working the same. The secondary patterns may be the same, or may be different from one another. The step of impressing the secondary pattern onto the material increases the maximum transverse dimension of the material from the centerline to the farthest point of the distorted material of up to 135% in one case, 150% in another case, 300% in a third case, and 700% in a fourth case, of the maximum transverse dimension from the centerline to the farthest point of the initial surfaces. The steps of impressing the primary and secondary patterns into the material does not materially reduce the minimum dimension of the material, when measured from any point on one of the distorted surfaces to the closest point on the opposite one of the distorted surfaces, below 95% in one case, and 50% in a second case, of the minimum dimension from any point on one of the initial surfaces to the closed point on the opposite initial surface.

The primary patterns impressed into the opposite sides of the material may be the same, or may be different. The step of impressing the primary patterns into the material does not reduce the minimum dimension of the further-distorted material, when measured from the centerline to any point on either of the further-distorted surfaces, below 95% of the minimum dimension of the material, when measured from the centerline to either one of the initial surfaces.

The primary patterns impressed into the opposite sides of the material may be the same, or may be different. The step of impressing the primary patterns into the material does not reduce the minimum dimension of the further-distorted material, when measured from the centerline to any point on either of the further-distorted surfaces, below 50% of the minimum dimension of the material, when measured from the centerline to either one of the initial surfaces.

In one aspect, the step of impressing the primary patterns onto each of the surfaces may further increase the dimension from the centerline to the farthest point of the further-distorted material.

The initial surfaces may be planar or may be supplied with some pattern or patterns impressed thereon. The step of impressing the primary and secondary patterns onto the material may be by a rigidizing operation, a stamping operation, a rolling operation, a pressing operation, an embossing operation, or by some other type of process or operation. Similarly, the material may be supplied with cooler tube openings and/or with flow-through openings of whatever pattern is desired.

The method may further include the additional step of bending the enhanced-surface wall such that the proximate ends are positioned adjacent one another, and jointing the proximate ends of the material together, as by welding to form an enhanced-surface tube. The method may include the further step of providing holes through the material.

As indicated above, the enhanced-surface wall may be installed in heat exchanger, in some type of fluid-handling apparatus or in still other forms of apparatus as well.

The primary patterns may be directional or non-directional. The enhanced-surface wall complies with at least on of the following ASME/ASTM designations: A249/A, A135, A370, A751, E213, E273, E309, E1806, A691, A139, A213, A214, A268, A 269, A270, A312, A334, A335, A498, A631, A671, A688, A691, A778, A299/A, A789, A789/A, A789/M, A790, A803, A480, A763, A941, A1016, A1012, A1047/A, A250, A771, A826, A851, B674, E112, A370, A999, E381, E426, E527, E340, A409, A358, A262, A240, A537, A530, A 435, A387, A299, A204, A20, A577, A578, A285, E165, A380, A262 and A179. Each of the foregoing designations is hereby incorporated by reference.

The material may be provided with a coating (e.g., a plating, etc.) on at least a portion of one of its initial surfaces, or such initial surface(s) may be chemically treated (e.g., electro-polished, etc.). Such coating and/or chemical treatment may be applied before, during or after the formation of the enhanced surfaces thereon. As used herein, the term "portion" includes a range of from 0-100%.

The invention also includes an enhanced-surface wall formed by the forgoing method.

Figure 5A:
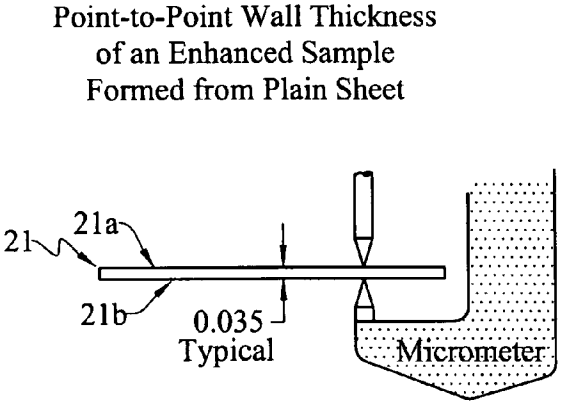
FIG. 5A is a schematic view, showing how the point-to-point wall thickness of a plain sheet is measured.
Figure 5B:
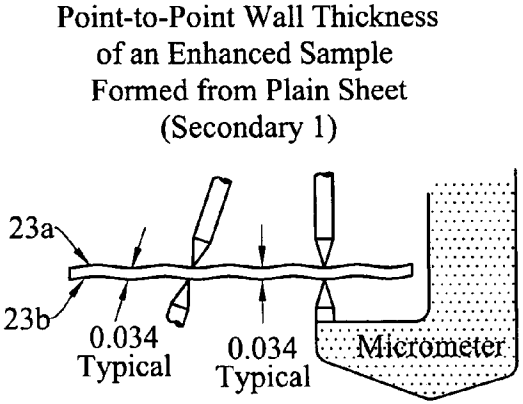
FIG. 5B is a schematic view, showing how the point-to-point wall thickness of the material is measured after the Secondary 1 patterns have been impressed therein.
Figure 5C:
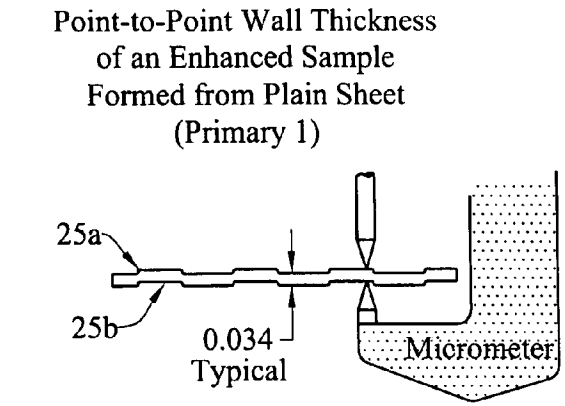
FIG. 5C is a schematic view showing how the point-to-point wall thickness of the Primary 1 patterns is measured.
Figure 5D:
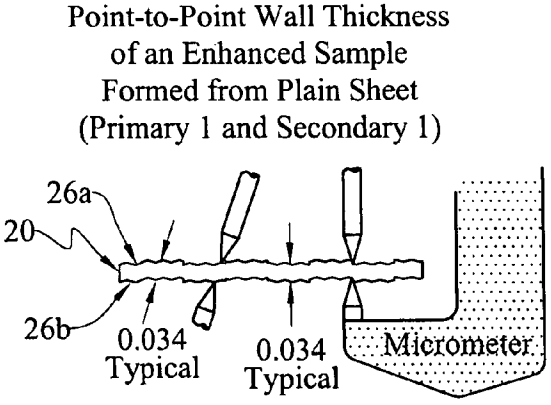
FIG. 5D is a schematic view showing how the point-to-point wall thickness of the finished enhanced-surface material is measured, this material having the super imposed Primary 1 and Secondary 1 patterns impressed thereon.

FIG. 5A-5D show how the point-to-point wall thickness is measured during various stages of the method. As used herein, the term "point-to-point wall thickness" means the thickness of the material from a point on one surface thereof to the closest point on the opposite surface thereof. Thus, FIG. 5A shows a micrometer as measuring the initial thickness between planar surfaces 21*a*, 21*b*. FIG. 5B shows the micrometer as measuring the wall thickness after the Secondary 1 patterns have been impressed thereon. This view schematically shows two measuring orientations, one being of the vertical thickness and the other being at an angle, such that the lesser of the two measured thicknesses may be used. FIG. 5C shows how the point-to-point wall thickness would be measured when the primary pattern is impressed into the material. Finally, FIG. 5D show the micrometer as measuring the point-to-point wall thickness of the material after the Primary 1 and Secondary 1 patterns have been impressed thereon. Here again, the lesser of the two measured thicknesses is used as the measure of the minimum wall thickness. These two illustrations of the orientation of the micrometer are not exhaustive of all possible orientations thereof.

Figure 6A:
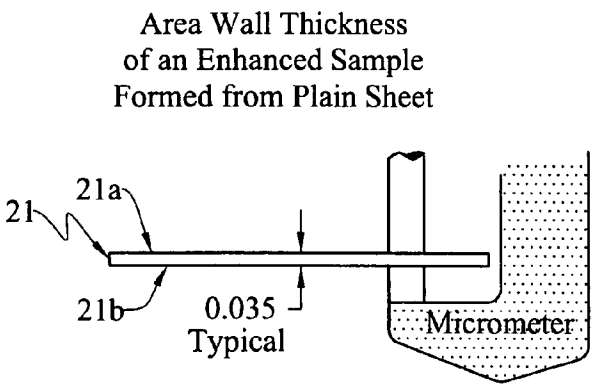
FIG. 6A is a schematic view showing how the area thickness of a plain sheet is measured.
Figure 6B:
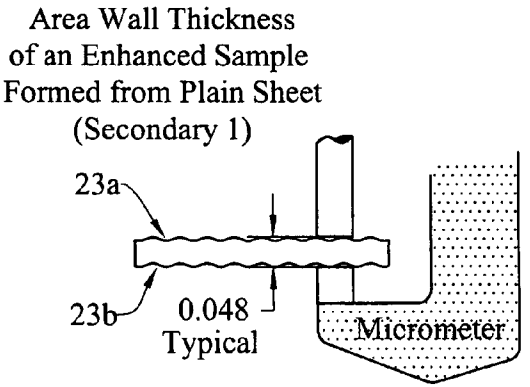
FIG. 6B is a schematic view showing how the area wall thickness is measured after the Secondary 1 patterns have been impressed thereon.
Figure 6C:
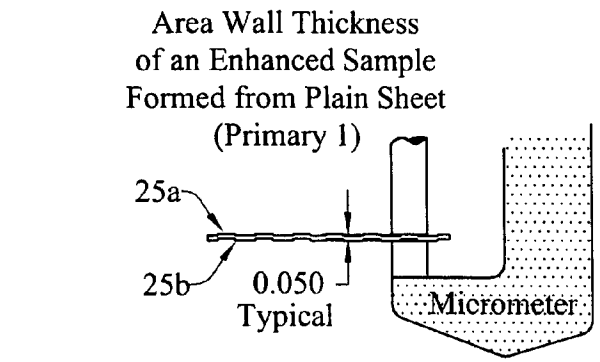
FIG. 6C is a schematic view showing how the area wall thickness is measured after the Primary 1 patterns have been impressed thereon.
Figure 6D:
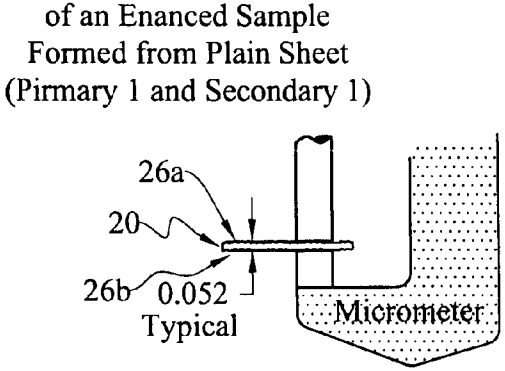
FIG. 6D is a schematic view showing how the area wall thickness of an enhanced-surface wall is measured after the Primary 1 and Secondary 1 patterns have been impressed thereon.

FIG. 6A-6D shows how the area thickness of the material is measured at various stages during the performance of the method. The thickness is measured by measuring the peak-to-peak distance of the opposed surfaces, and, usually, by encompassing several peaks along each of the two surfaces. Thus, FIG. 6A shows the micrometer is measuring the thickness of the initially-supplied material having planar upper and lower surfaces 21*a*, 21*b*, respectively. Since these surfaces are planar, the micrometer can simply measure the distance therebetween. FIG. 6B shows the micrometer as measuring the thickness of the material after the Secondary 1 pattern has been impressed thereon. Note that the micrometer is measuring the peak-to-peak thickness of the amplitudes of both surfaces. FIG. 6C shows the micrometer as measuring the thickness of the material if the Primary 1 patterns were to be impressed on the initially-supplied material. In this view, the micrometer is again measuring the peak-to-peak thickness across multiple characters impressed on the surfaces. Finally, FIG. 6D shows the micrometer as measuring the wall thickness of the material after the Primary 1 and Secondary 1 patterns have been impressed thereon.

Because the "point-to-point wall thickness" means the thickness of the material fro a point on one surface thereof to the closest point on the opposite surface thereof, it is sometimes required to measure such dimension both vertically and at various angles to determine which is the minimum thickness. However, because the "area thickness" refers to a peak on one surface to a peak on the opposite surface dimension, this can usually be measured vertically. The "area thickness" preferably encompasses multiple peaks on each surface.

Second Embodiment (FIGS. 7A-7C)

A second primary pattern, designated the Primary 2 pattern, is illustrated in FIGS. 7A-7C, and is generally indicated at 30. This pattern somewhat resembles a raised honeycomb, and has an upper surface 31*a* and a lower surface 31*b*. This pattern is directional in the vertical direction, but non-directional in the horizontal direction. The vertical and horizontal transverse cross-sections are shown in FIGS. 7B-7C.

Third Embodiment (FIGS. 8A-8C)

FIGS. 8A-8C show another furrow-like primary pattern, designated the Primary 3 pattern. This pattern is generally indicated at 32. This pattern is directional in the vertical direction, but is non-directional in the horizontal direction. The vertical and horizontal transverse cross-sections are shown in FIGS. 8B-8C. This pattern has sinusoidal undulations, albeit of different periods, in each of the two orthogonal transverse directions on its upper and lower surfaces.

Figure 9C:
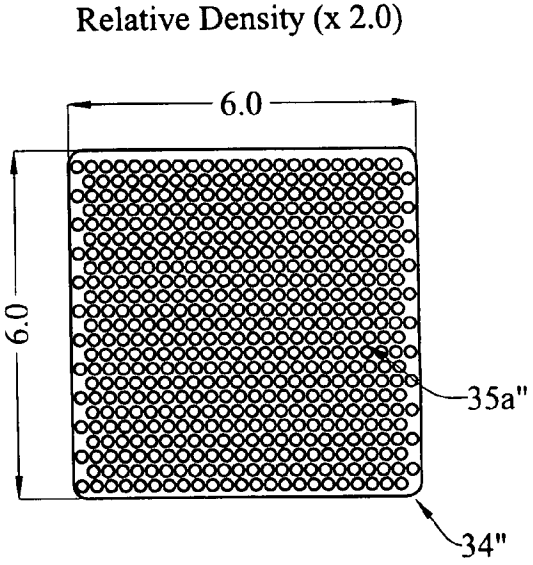
FIG. 9C is a view similar to FIGS. 9A and 9B, but showing another variant form of the Primary 4 pattern having a character surface density of 2.0.
Figure 9B:
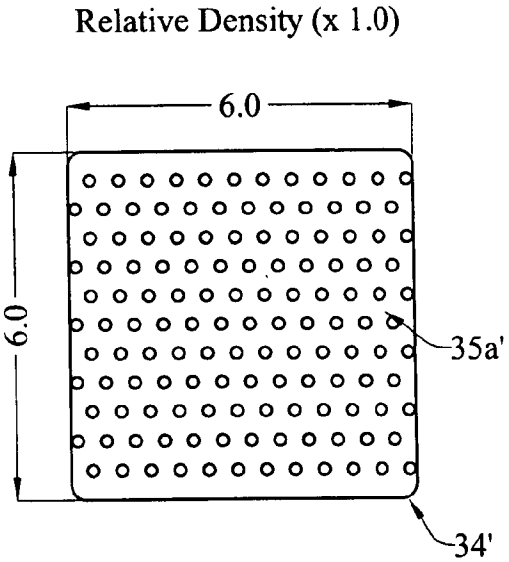
FIG. 9B is a view similar to FIG. 9A, but showing a variant form of the Primary 4 pattern having a character surface density of 1.0.
Figure 9A:
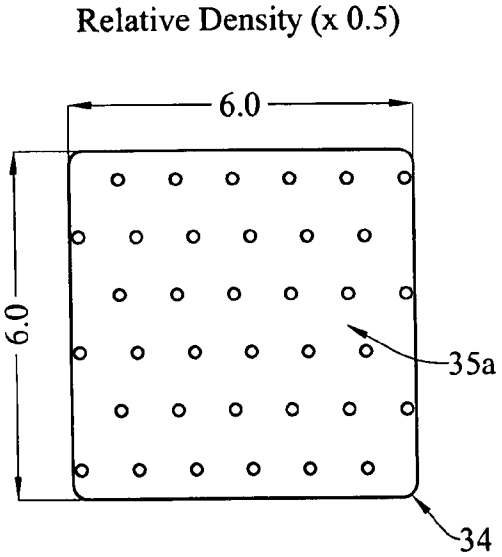
FIG. 9A is a top plan view of another primary pattern, designated the Primary 4 pattern, impressed into a sheet of material, this pattern having a character surface density of 0.5.

Fourth Embodiment (FIGS. 9A-9C)

FIGS. 9A-9C show another secondary pattern designated the Secondary 2 pattern. This pattern comprises of a series of dimple-like indentations on one surface, and vertically-aligned convexities on the opposite surface. These dimples can be staggered or in-line, as desired. This pattern is generally indicated at 34 in FIG. 9A, and is shown as having an upper surface 35*a*.

FIGS. 9B-9C show density variations on the pattern shown in FIG. 9A. In FIG. 9A, the pattern is indicated at 34', and the upper surface is indicated at 35*a*'. The surface density of the dimple-like characters in pattern 34 shown in FIG. 9A is 0.5 of that for the modified pattern 34' shown is in FIG. 9B, and 0.25 of that for the further-modified pattern 34" shown in FIG. 9C. Thus, the surface density of the dimple-like characters in FIG. 9B is twice that shown in FIG. 9A. Similarly, surface density of the dimple-like characters in FIG. 9C is twice the surface density of the characters in FIG. 9B, and four times the surface density of the characters shown in FIG. 9A.

FIGS. 9A-9C are drawn to the same scale, as indicated by the 6.0×6.0 dimensions.

Fifth Embodiment (FIGS. 10A-10C)

FIGS. 10A-10C show another chevron-like primary pattern designated the Primary 4 pattern. This pattern is non-directional in both the horizontal and vertical directions. The pattern is generally indicated at 36, and has upper and lower surfaces 38*a*, 38*b*.

Figure 11A:
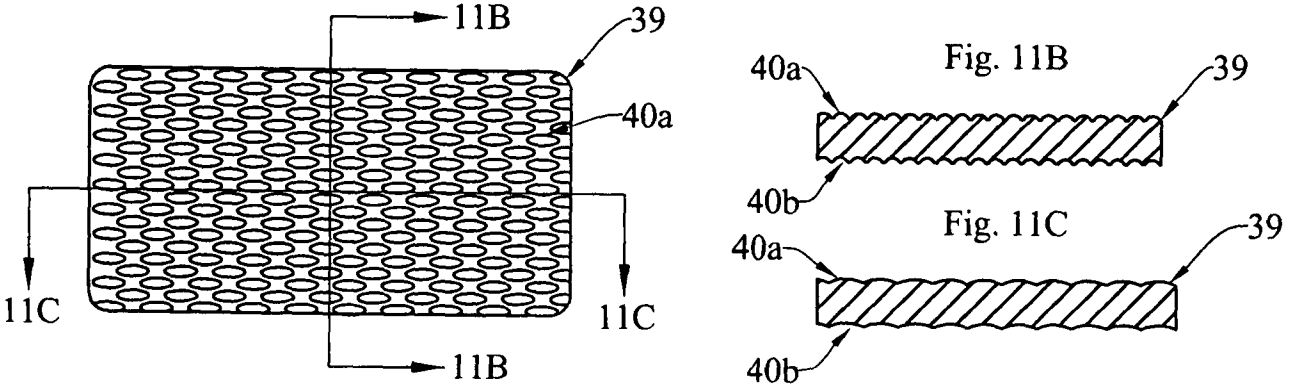
FIG. 11A is a top plan view of another secondary pattern, designated the Secondary 2 pattern, impressed into the material, this view showing the individual characters as being somewhat oval-shaped.

Sixth Embodiment (FIGS. 11A-11C)

FIGS. 11A-11C show another form of secondary pattern designated the Secondary 2 pattern, impressed into the material. In this form, the individual dimples or characters are somewhat oval-shaped. Note that the period of the dimples is different in the two orthogonal directions, as shown in FIGS. 11B-11C. This pattern is generally indicated at 39, and is shown as having upper and lower surfaces 40*a*, 40*b*, respectively.

Figure 12A:
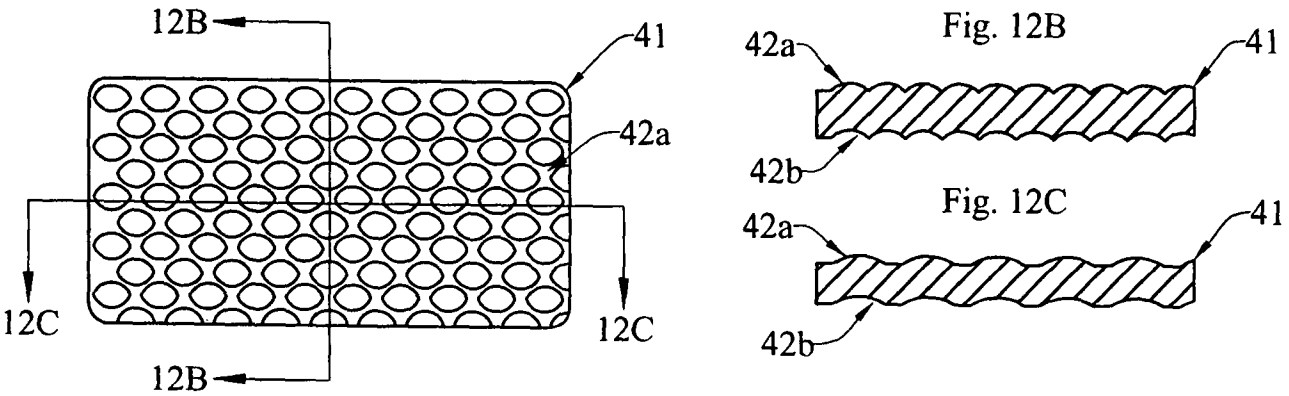
FIG. 12A is a top plan view of another secondary pattern, designated the Secondary 3 pattern, impressed onto a length of material, this view showing the individual characters as being somewhat lemon-shaped.

Seventh Embodiment (FIGS. 12A-12C)

FIGS. 12A-12C show still another type of secondary pattern, designated the Secondary 3 pattern. The dimples or characters of this pattern appear to be somewhat lemon-shaped. Here again, note that the periods of the patterns is different in each of the two orthogonal transverse directions, as shown in FIGS. 12B-12C. This pattern is generally indicated at 41, and is shown as having upper and lower surfaces 42*a*, 42*b*, respectively.

Figure 13A:
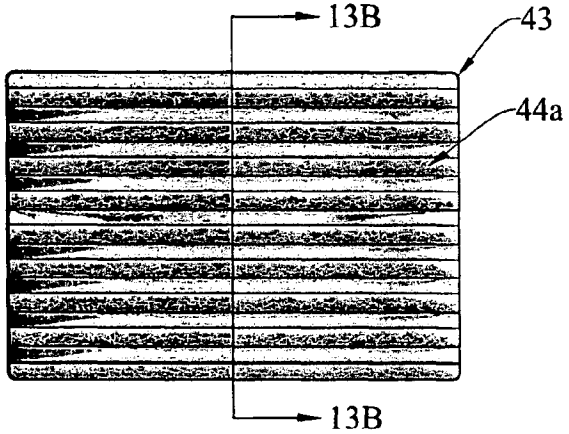
FIG. 13A is a top plan view of another primary pattern, designated the Primary 6 pattern, impressed into a length of material.
Figure 13B:
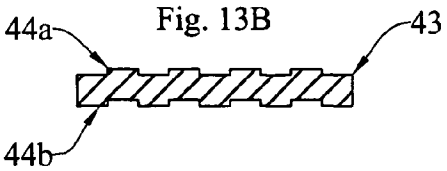
FIG. 13B is a fragmentary transverse vertical sectional view thereof, taken generally on line 13B-13B of FIG. 13A.

Eighth Embodiment (FIGS. 13A-13B)

FIGS. 13A-13B are used to illustrate a directional pattern, designated the Primary 6 pattern. This pattern is generally indicated at 43, and is shown as having upper and lower surfaces 44*a*, 44*b*, respectively Note that the pattern appears to have a series of step functions on its opposite surfaces, as shown in FIG. 13B. Note also, and the characters are aligned such that each projection on one surface corresponds with an indentation on the other surface. This pattern is directional in the horizontal direction, but not in the vertical direction.

Figure 14A:
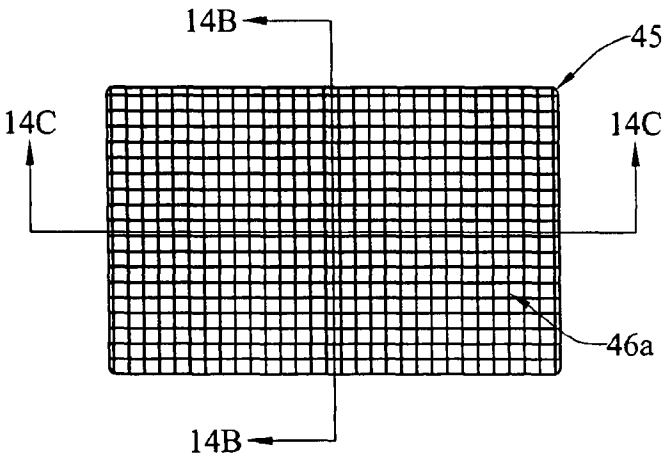
FIG. 14A is still another example of a criss-crossed directional primary pattern, designated the Primary 7 pattern, impressed on a length of material, this pattern being directional in both the longitudinal and transverse directions.
Figure 14B:
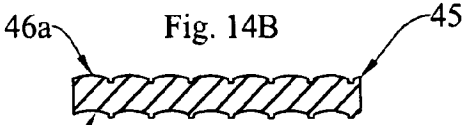
FIG. 14B is fragmentary transverse vertical sectional view thereof, taken generally on line 14B-14B of FIG. 14A.
Figure 14C:
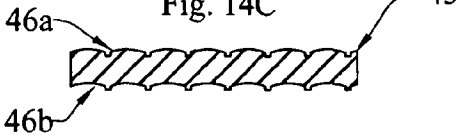
FIG. 14C is a fragmentary transverse horizontal sectional view thereof, taken generally on line 14C-14C of FIG. 14A.

Ninth Embodiment (FIGS. 14A-14C)

FIGS. 14A-14C show a criss-crossed pattern designated the Primary 7 pattern, impressed on the material. This pattern is generally indicated at 45, and is shown as having an upper surface 46*a* and a lower surface 46*b*. This pattern is directional (i.e., not interrupted) in both the horizontal and vertical directions. Note that the period of the characters is the same in both orthogonal transverse directions.

Tenth Embodiment (FIGS. 15A-15C)

FIGS. 15A-15C show an irregular pebble-like, albeit repeating, non-directional secondary pattern impressed on the material. This pattern is designated the Secondary 4 pattern. This pattern is generally indicated at 48, and has upper and lower surfaces 49*a*, 49*b*, respectively. The cross-sections in the orthogonal axes are shown in FIGS. 15B-15C, respectively. In FIGS. 15B-15C, note that the indentation on one surface is vertically aligned with a projection on the other surface. This pattern is non-directional in the sense that the pattern is interrupted in each of the horizontal and vertical directions. As used herein, the term "directional" with respect to a pattern means that the lines of the pattern are continuous and not interrupted along a direction, whereas the term "non-directional" means that the lines of the pattern are interrupted along a direction, even though the pattern may repeat.

Eleventh Embodiment (FIGS. 16A-16C)

FIGS. 16A-16C show still another honeycomb-like non-directional secondary pattern, designated the Secondary 5 pattern impressed on a material. This pattern is generally indicated at 50, and is shown as having upper and lower surfaces 51*a*, 51*b*, respectively. This pattern is non-directional in the vertical and horizontal directions.

Method of Making an Enhanced-Surface Tube (FIG. 17)

FIG. 17 depicts one method of making a round tube having enhanced surfaces. According to this process, a coil 52 having the primary and secondary patterns (and, optionally, whatever cooler tube and flow-through openings are desired) is unwound. The leading edge of the material passes through a series of rollers and roller dies, severally indicated at 53, within which the planar sheet material is rolled into a round tube with the two longitudinal edges being arranged closely adjacent, or, preferably, abutting, one another. The rolled tube is then passed through a preheating unit 54 and a welding unit 55 to weld the longitudinal edges together. The welded tube is then passed through a secondary heating unit 56 to anneal the weld and the material, and is then cooled in a cooling unit 58. The cooled welded tube is then passed through a deburrer to smooth the weld edges, and is further advanced rightwardly by rollers 60, 60.

Figure 18A:
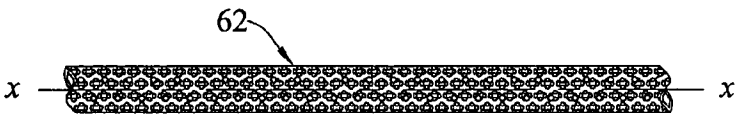
FIG. 18A is a side elevation of a round tube having an optional coating on its outer surface.
Figure 18B:
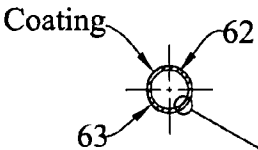
FIG. 18B is a right end elevation of the round tube shown in FIG. 18A.
Figure 18C:
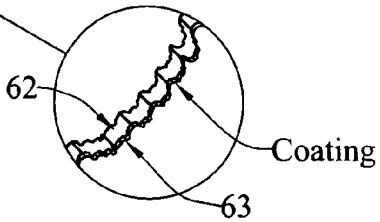
FIG. 18C is an enlarged detail view of the round tube, taken within the indicated circle in FIG. 18B, and particularly showing the coating on the outer surface of the tube.

Round Tube (FIGS. 18A-18C)

Tubes may have many different shapes and cross-sections. FIGS. 18A-18C depict a length of welded round tube that may be manufactured by the process indicated in FIG. 17. The tube, generally indicated at 62, is shown as having primary and secondary patterns. As best shown in FIG. 18B, tube 62 has a thin-walled circular transverse cross-section.

The tube outer wall is also shown as having a coating 63 thereon. This coating may be a plating, or some other form of coating or lamination. This coating is optional and may be provided on any of the enhanced surfaces disclosed herein. The coating can be provided on the inner or outer surface of a tube, as desired.

Figure 19A:
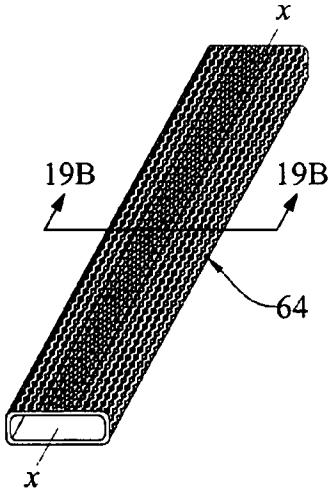
FIG. 19A is an isometric view of a rectangular tube.
Figure 19B:
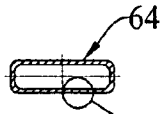
FIG. 19B is a fragmentary transverse vertical sectional view, taken generally on line 19B-19B of FIG. 19A, of the rectangular tube.
Figure 19C:
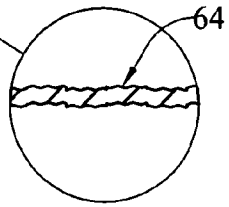
FIG. 19C is an enlarged detail view of a portion of the wall of the rectangular tube, this view being taken within the indicated circle in FIG. 19B.

Rectangular Tube (FIGS. 19A-19C)

As noted above, not all tubes have a round transverse cross-section. Some tubes have oval-shaped cross-sections, polygonal cross-sections, or the like.

FIGS. 19A-19C depict a tube 64 having a generally-rectangular transverse cross-section, with primary and secondary patterns on its inner and outer surfaces. This tube may, if desired, be formed with a coating or may be chemically treated.

U-Shaped Tube (FIGS. 20A-20C)

FIGS. 20A-20C depict a round tube which is bent to have a U-shape, when seen in elevation. This tube, generally indicated at 65, has primary and secondary patterns on its inner and outer surfaces.

Coil Formed of Round Tube (FIGS. 21A-21D)

FIGS. 21A-21D depict a helically-wound coil formed from a length of round tubing. This coil, generally indicated at 66, has primary and secondary patterns on its inner and outer surfaces.

Method of Making an Enhanced-Surface Fin (FIG. 22)

FIG. 22 is a schematic view of one process for forming enhanced-surface fins. In this process, a coil 68 of material with primary and secondary patterns is unrolled. The leading edge of the material passes around idler rollers 69*a*, 69*b*, c9*c*, and is then passed between an opposed pair of roller dies 70*a*, 70*b*, which punch or form various holes (e.g., cooling tube holes and/or flow-through holes in whatever pattern is desired) in the material. The leading edge is then passed through a second pair of roller dies 71*a*, 71*b*, which form flanges on the material. The leading edge is then passed under a cut-off shear 72, where individual fins, severally indicated at 73, are cut from the roll material. These fins are moved rightwardly by the action of rollers 74.

Fins Having Cooler Tube Openings and Flow-Through Openings (FIGS. 23A-25E)

FIGS. 23A-25E show different forms of improved fins having different combinations of primary and secondary patterns, and having cooler tube openings and variously-sized flow through openings.

Figure 23B:
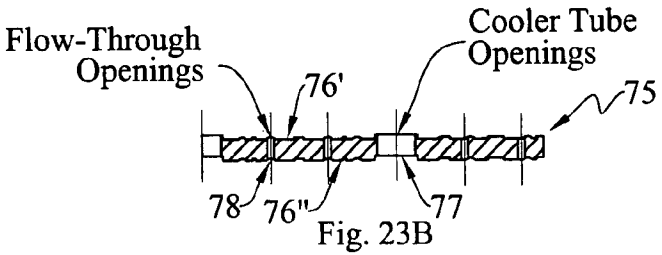
FIG. 23B is a fragmentary vertical sectional view thereof, taken generally on line 23B-23B of FIG. 23A.
Figure 23A:
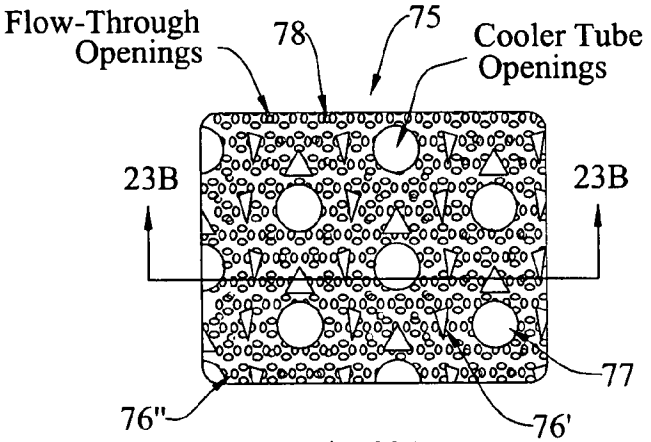
FIG. 23A is a front elevation of a first enhanced-surface fin having primary and secondary patterns impressed thereon, and having cooler tube and flow-through openings.

A first form of fin is generally indicated at 75 in FIGS. 23A-23B. In this first form, the individual characters of the primary and secondary patterns are indicated at 76', 76", respectively. The cooling tube openings (i.e., the openings in the fins to accommodate passage of various cooling tubes (not shown)) are severally indicated at 77, and the relatively-small flow-through openings are severally indicated at 78.

Figure 24B:
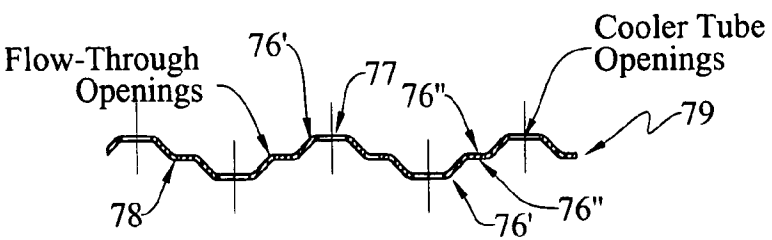
FIG. 24B is a fragmentary vertical sectional view thereof, taken generally on line 24B-24B of FIG. 24A.
Figure 24A:
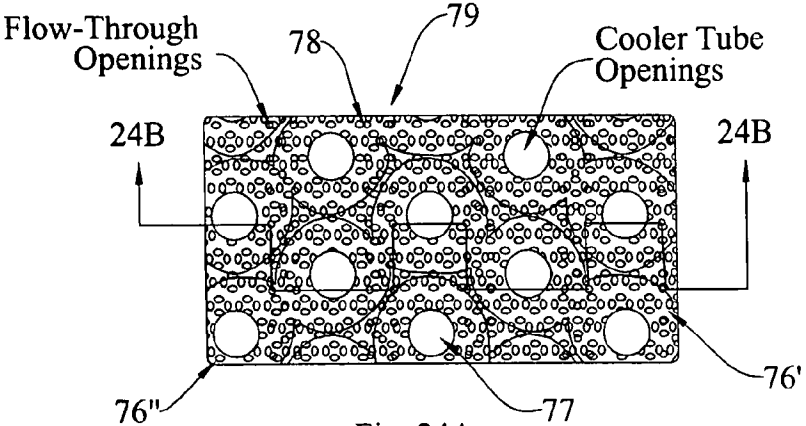
FIG. 24A is a front elevation of a second enhanced-surface fin having primary and secondary patterns impressed thereon, and having cooler tube and flow-through openings.

A second form of fin is generally indicated at 79 in FIGS. 24A-24B. In this second form, the individual characters of the primary and secondary patters are again indicated at 76', 76", respectively. The cooling tube openings and the relatively-small flow-through openings are again indicated at 77, 78, respectively. Notice that second fin 78 is thinner, and more deeply distorted than first fin 75.

Figures 25A, 25B, 25C, 25D, 25E:
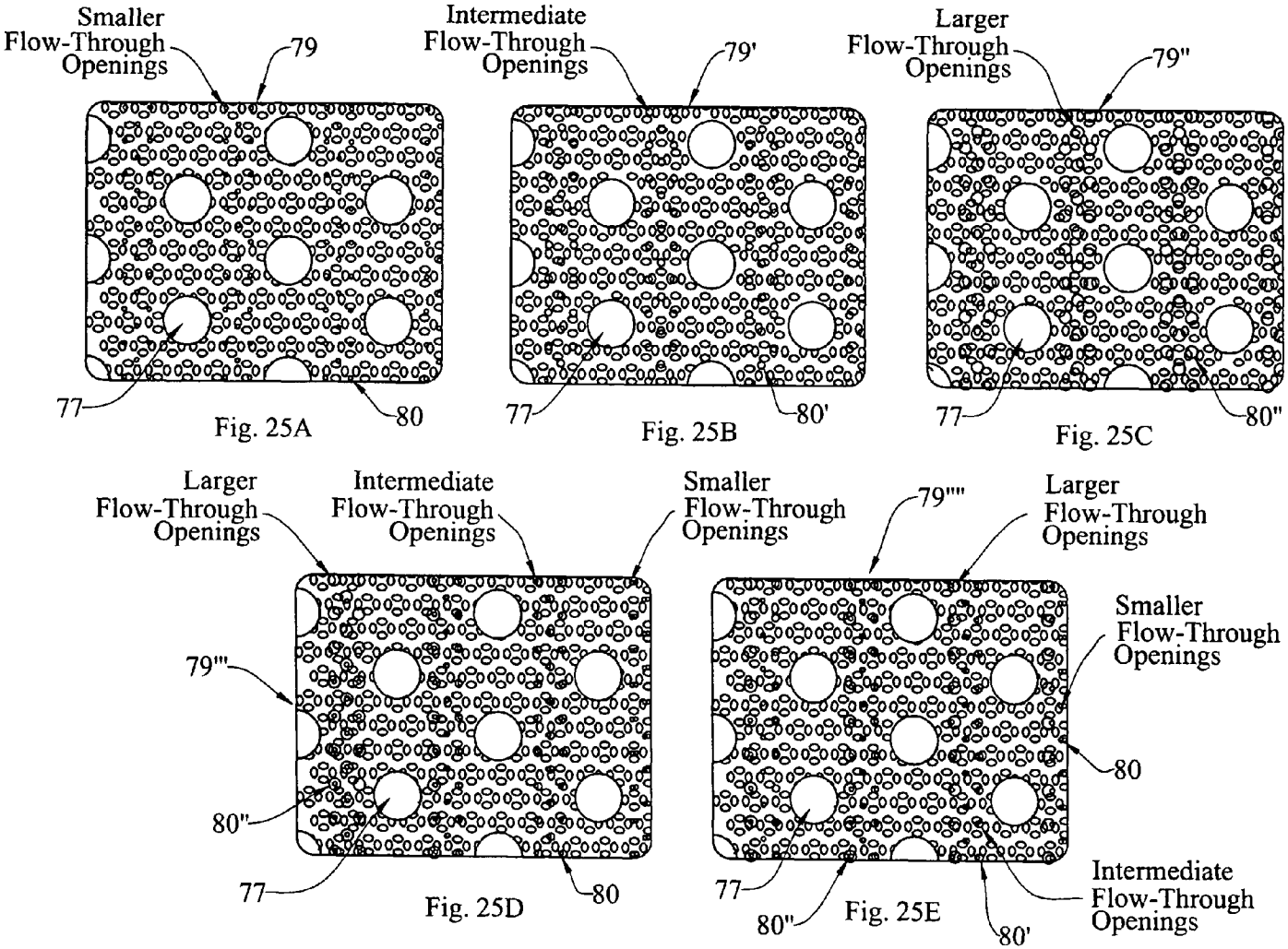
FIG. 25A is a front elevation of a third enhanced-surface fin having cooler tube openings and smaller flow-through openings.
FIG. 25B is a front elevation of a fourth enhanced-surface fin having cooler tube openings and intermediate flow-through openings.
FIG. 25C is a front elevation of a fifth enhanced-surface fin having cooler tube openings and larger flow-through openings.
FIG. 25D is a front elevation of a sixth enhanced-surface fin having cooler tube openings and one combination of smaller, intermediate and larger flow-through openings.
FIG. 25E is a front elevation of a seventh enhanced-surface fin having cooler tube openings and another combination of smaller, intermediate and larger flow-through openings.

Five different fins are illustrated in FIGS. 25A-25E. In each of these figures, the cooling tube openings or holes are indicated at 77. The salient difference between these five figures lies in the size and configuration of the flow-through openings. In FIG. 25A, a third form of fin, generally indicated at 79, is shown as having a plurality of smaller-sized flow-though openings, severally indicated at 80. In FIG. 25B, a fourth form of fin, generally indicated at 79', is shown as having intermediately-sized flow-through openings, severally indicated at 80'. In FIG. 25C, a fifth form of fin, generally indicated at 79", is shown as having larger-sized flow-through openings, severally indicated at 80". FIG. 25D illustrates a sixth form of fin having various vertical columns of small, intermediate and large flow-through holes. FIG. 25E illustrates a seventh form of fin having another combination of small, intermediate and large flow-through holes. In each of these cases, the fin has primary and secondary patterns.

Improved Heat Exchanger (FIG. 26)

An improved heat exchanger, generally indicated at 81, is shown in FIG. 26 as having an outer shell 82. A serpentine enhanced-surface heat transfer tube 83 extends between a hot inlet and a hot outlet on the shell. Cold fluid is admitted to the shell through a cold inlet, and flows around the tube toward a cold outlet, through which it exits the shell. The inlet and outlet connections and/or the tube geometry may be changed, as desired.

Improved Cooler (FIGS. 27A-27E)

FIGS. 27A-27E depict an improved cooler, generally indicated at 84. This cooler is shown as having a plurality of enhanced-surface tubes, severally indicated at 85, that penetrate a bottom 86 and that rise upwardly through a plurality of vertically-spaced fins, severally indicated at 88. The tubes wind through the fins in a serpentine manner. Here again the fluid connections and/or the tube geometry may be changes, as desired. Each fin is shown as having a plurality of cooler tube openings 89 to accommodate passage of the tubes. Each fin has primary and secondary patterns, and may optionally have a number of flow-through openings in whatever pattern is desired.

Figure 27A:
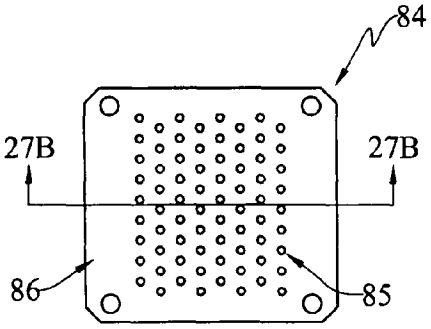
FIG. 27A is a bottom plan view of an improved fluid cooler having enhanced-surface tubes therewithin.
Figure 27B:
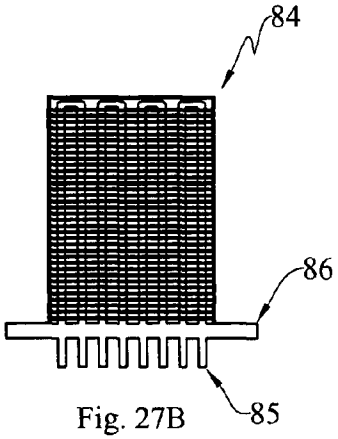
FIG. 27B is a fragmentary horizontal sectional view thereof, taken generally on line 27B-27B of FIG. 27A.
Figure 27C:
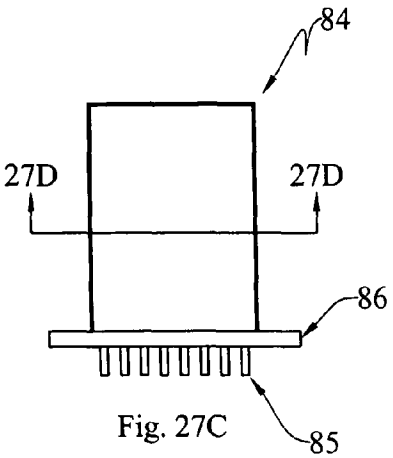
FIG. 27C is a side elevation of the improved cooler shown in FIG. 27A, with the cover in place.
Figure 27D:
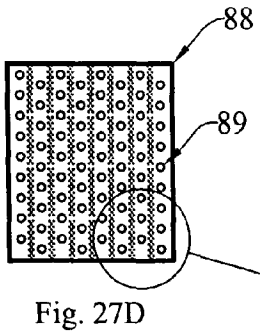
FIG. 27D is a fragmentary vertical sectional view thereof, taken generally on line 27D-27D of FIG. 27C, showing a bottom plan view of one of the fins.
Figure 27E:
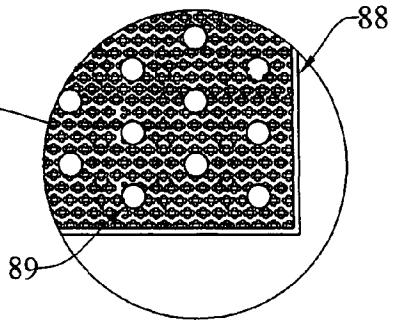
FIG. 27E is an enlarged detail view of a portion of one of the fins, this view being taken within the indicated circle of FIG. 27D.

FIG. 27A depicts a plan view of the cooler bottom. FIG. 27B is a fragmentary vertical sectional view of the cooler, taken generally on line 27B-27B of FIG. 27A, and shows the tubes as passing upwardly and downwardly through aligned cooler tube openings in the fins. FIG. 27C is a side elevation of the cooler. FIG. 27D is a fragmentary horizontal sectional view through the cooler, taken generally on line 27D-27D of FIG. 27C, and shows a bottom plan view of one of the fins. Finally, FIG. 27E is an enlarged detail view of the lower right portion of the fin, this view being taken within the indicated circle in FIG. 27D.

Improved Fluid-Flow Vessel (FIG. 28)

An improved fluid-flow vessel is generally indicated at 90 in FIG. 28. This vessel is shown as including a process column, generally indicated at 91, that includes a plurality of vertically-spaced enhanced surface walls, severally indicated at 92. Vapor rises upwardly through the column by sequentially passing through the various walls, and liquid descends through the column by also passing through the various walls. Vapor at the top of the column passes via conduit 93 to a condenser 94. Liquid is returned to the uppermost chamber within the column by a conduit 95. At the bottom of the process column, collected liquid is supplied via a conduit 96 to an enhanced-surface reboiler 98. Vapor leaving this reboiler is supplied to the lowermost chamber of the column via a conduit 99.

Improved Heat Exchanger Plate (FIGS. 29A-29B)

FIG. 29A depicts an improved heat exchanger plate, generally indicated at 100. A plurality of such plates may be stacked on top of one another, and adjacent plates may be sealingly separated by a gasket (not shown) to define flow passageways therebetween. FIG. 29B shows that portions of the heat exchanger plate may have enhanced surfaces thereon so as to facilitate heat transfer. FIG. 29B clearly shows that the illustrated portion of the plate may have primary patterns 101 and secondary patterns 102.

Therefore, the present invention broadly provides an improved method of forming an enhanced-surface wall for use in an apparatus for performing a process, an improved enhanced-surface wall, and uses thereof.

Modifications

The present invention contemplates that many changes and modifications may be made. For example, while it may be preferred to form the material of stainless steel, other types of material(s) (e.g., various alloys of aluminum, titanium, copper, etc, or various ceramics) may be used. The material may be homogenous or non-homogenous. It may be coated or chemically treated, either before, during or after the method described herein. As illustrated above, the primary and secondary patterns may have a variety of different shapes and configurations, some regular and directional, and others not. The same types or configurations of characters may be used in the primary and secondary patters, with the difference residing in the depth and/or surface density of such characters. The various heat transfer devices disclosed herein may be complete in and of themselves, or may be portions of larger devices, which may have shapes other than those shown.

Therefore, while the improved method and apparatus has been shown and described, and several modifications and changes thereof discussed, persons skilled in this art will readily appreciated the various additional changes and modification may be made without departing from the spirit of the invention, as defined and differentiated by the following claims.

What is claimed is:

1. The method of forming an enhanced-surface wall for use in an apparatus for performing a process, comprising the steps of:

providing a length of material having opposite initial surfaces, said material having a longitudinal centerline positioned substantially midway between said initial surfaces, said material having an initial transverse dimension measured from said centerline to a point on either of said initial surfaces located farthest away from said centerline, each of said initial surfaces having an initial surface density, said surface density being defined as the number of characters on an surface per unit of projected surface area;

impressing secondary patterns having secondary pattern surface densities onto each of said initial surfaces to distort said material and to increase the surface densities on each of said surfaces and to increase the transverse dimension of said material from said centerline to the farthest point of such distorted material;

wherein the step of impressing said secondary patterns onto said material increases the maximum transverse dimension of said material from said centerline to the farthest point of said distorted material of up to 150% of the maximum transverse dimension from said centerline to the farthest point on either of said initial surfaces; and impressing primary patterns having primary pattern surface densities onto each of such distorted surfaces to further distort said material and to further increase the surface densities on each of said surfaces;

wherein the step of impressing said primary patterns onto said material does not reduce the minimum dimension of such further-distorted material, when measured from said centerline to any point on either of such further-distorted surfaces, below 50% of the minimum dimension of said material, when measured from said centerline to the farthest point on either of said initial surfaces;

thereby to provide an enhanced-surface wall for use in an apparatus for performing a process.

2. The method as set forth in claim 1 wherein each secondary pattern surface density is greater than each primary pattern surface density.

3. The method as set forth in claim 1 wherein the step of impressing said secondary patterns onto each of said initial surfaces includes the additional step of:

cold-working said material.

4. The method as set forth in claim 1 wherein the step of impressing said primary patterns onto each of distorted surfaces includes the additional step of:

cold-working said material.

5. The method as set forth in claim 1 wherein said secondary patterns are the same.

6. The method as set forth in claim 5 wherein said secondary patterns are shifted relative to one another such that a maximum dimension from said centerline to one distorted surface will correspond to a minimum dimension from said centerline to the other distorted surface.

7. The method as set forth in claim 1 wherein the step of impressing said secondary patterns onto said material does not reduce the minimum dimension of said material, when measured from any point on one of such distorted surfaces to the closest point on the opposite one of such distorted surfaces, below 95% of the minimum dimension from any point on one of said initial surfaces to the closest point on the opposite initial surface.

8. The method as set forth in claim 1 wherein the step of impressing said secondary patterns onto said material does not reduce the minimum dimension of said material, when measured from any point on one of such distorted surfaces to the closest point on the opposite one of such distorted surfaces, below 50% of the minimum dimension from any point on one of said initial surfaces to the closest point on the opposite initial surface.

9. The method as set forth in claim 1 wherein said primary patterns are the same.

10. The method as set forth in claim 9 wherein said primary patterns are shifted relative to one another such that a maximum dimension from said centerline to one further-distorted surface will correspond to a minimum dimension from said centerline to the other further-distorted surface.

11. The method as set forth in claim 1 wherein the step of impressing said primary patterns onto said material does not reduce the minimum dimension of such further-distorted material, when measured from said centerline to any point on either of such further-distorted surfaces, below 95% of the minimum dimension of said material, when measured from said centerline to the farthest point on either of said initial surfaces.

12. The method as set forth in claim 1 wherein the opposite initial surfaces of said material are planar.

13. The method as set forth in claim 1 wherein the steps of impressing said patterns includes the step of impressing said patterns by at least one of a stamping and rolling operation.

14. The method as set forth in claim 1, and further comprising the additional steps of:

bending said enhanced-surface wall such that the proximate ends are positioned proximate to one another; and joining the proximate ends of said material together;

thereby to form an enhanced-surface tube.

15. The method as set forth in claim 14 wherein the step of joining the proximate ends of said material together, includes the further step of:

welding the proximate ends of said material to join them together.

16. The method as set forth in claim 1, and further comprising the additional step of:

providing holes through said material.

17. The method as set forth in claim 1, and further comprising the additional step of:

installing said enhanced-surface wall in a heat transfer device.

18. The method as set forth in claim 1, and further comprising the additional step of:

installing said enhanced-surface wall in a fluid-handling apparatus.

* * * * *